US010570643B2

(12) United States Patent
Widén

(10) Patent No.: US 10,570,643 B2
(45) **Date of Patent: *Feb. 25, 2020**

(54) CYLINDER LOCK CORE FOR A CYLINDER LOCK UNIT

(71) Applicant: WINLOC AG, Zug (CH)

(72) Inventor: Bo Widén, Torshälla (SE)

(73) Assignee: WINLOC AG, Zug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/211,875

(22) Filed: Dec. 6, 2018

(65) Prior Publication Data

US 2019/0106905 A1 Apr. 11, 2019

Related U.S. Application Data

(63) Continuation-in-part of application No. 15/617,779, filed on Jun. 8, 2017, now Pat. No. 10,337,210.

(51) Int. Cl.

| | |
|---|---|
| ***E05B 27/00*** | (2006.01) |
| ***E05B 19/00*** | (2006.01) |
| ***E05B 9/08*** | (2006.01) |

(52) U.S. Cl.

CPC ..... *E05B 27/0078* (2013.01); *E05B 9/086* (2013.01); *E05B 19/0064* (2013.01);
(Continued)

(58) Field of Classification Search

CPC ..... E05B 15/14; E05B 19/0017; E05B 19/14; E05B 19/0041; E05B 19/0035;
(Continued)

(56) References Cited

U.S. PATENT DOCUMENTS

| | | | |
|---|---|---|---|
| 1,656,854 | A | 1/1928 | Best |
| 3,298,211 | A | 1/1967 | Russell et al. |

(Continued)

FOREIGN PATENT DOCUMENTS

| | | | |
|---|---|---|---|
| EP | 1240399 | A1 | 9/2002 |
| SE | 422480 | B | 3/2008 |

(Continued)

OTHER PUBLICATIONS

CX5 High Security Cylinders, Small Format, Interchangeable Core, Service Manual, www.cx5security.com.

(Continued)

*Primary Examiner* — Suzanne L Barrett

(74) *Attorney, Agent, or Firm* — Birch, Stewart, Kolasch & Birch, LLP

(57) ABSTRACT

A cylinder lock unit includes a housing having an upper part and a lower part that includes a cylindrical bore accommodating a rotatable key plug. A back region of the key plug has a minimum length of 50% of a total length of the key plug with an adjoining front region having a maximum length of 50% of the total length. The front region accommodates at least one side locking mechanism confined entirely within the front region of the key plug that includes a longitudinal row of at least two coded side locking tumblers each interacting with the lower part of the housing wherein each side locking mechanism is movable independently of each other with at least three different code positions for each coded side locking tumbler and a plurality of different code combinations for the at least two coded side locking tumblers in each of the longitudinal row.

39 Claims, 12 Drawing Sheets

(52) U.S. Cl.
CPC ..... *E05B 27/0007* (2013.01); *E05B 27/0039* (2013.01); *E05B 27/0082* (2013.01); *E05B 27/0017* (2013.01)

(58) Field of Classification Search
CPC ..... E05B 19/0058; E05B 19/0023; E05B 19/0052; E05B 19/24; E05B 19/00; E05B 19/0064; E05B 21/00; E05B 27/00; E05B 27/0003; E05B 27/0007; E05B 27/001; E05B 27/0014; E05B 27/0017; E05B 27/0021; E05B 27/0032; E05B 27/0039; E05B 27/0042; E05B 27/0005; E05B 27/0053; E05B 27/0082; E05B 27/083; E05B 27/086; E05B 29/0006; E05B 29/00; E05B 29/0013; E05B 29/002; E05B 29/0026; E05B 29/0033; E05B 29/004; E05B 29/0066; E05B 29/086; E05B 35/08; E05B 63/0056; E05B 27/0078
USPC ..... 70/371
See application file for complete search history.

(56) References Cited

U.S. PATENT DOCUMENTS

| | | | |
|---|---|---|---|
| 3,499,302 | A | 3/1970 | Spain et al. |
| 4,075,879 | A | 2/1978 | Christopher |
| 4,123,926 | A | 11/1978 | Elder |
| 4,282,731 | A | 8/1981 | Taksony |
| 4,328,690 | A | 5/1982 | Oliver |
| 4,393,673 | A | 7/1983 | Widén |
| RE31,910 | E | 6/1985 | Oliver |
| 4,630,457 | A | 12/1986 | Kincaid et al. |
| 4,672,827 | A | 6/1987 | Craig |
| 4,712,401 | A | 12/1987 | Monahan |
| 4,715,201 | A | 12/1987 | Craig |
| 4,756,177 | A | 7/1988 | Widen |
| 4,761,978 | A | 8/1988 | Walla |
| 4,998,426 | A | 3/1991 | Genakis |
| 5,119,654 | A | 6/1992 | Ceron et al. |
| 5,131,249 | A | 7/1992 | Baden et al. |
| 5,176,015 | A | 1/1993 | Sussina |
| 5,375,444 | A | 12/1994 | Smith |
| 5,419,168 | A | 5/1995 | Field |
| 5,421,179 | A | 6/1995 | Bergström |
| 5,431,034 | A | 7/1995 | Fann et al. |
| 5,507,163 | A | 4/1996 | Juang |
| 5,715,717 | A | 2/1998 | Widen |
| 5,784,910 | A | 7/1998 | Eizen et al. |
| 5,813,260 | A | 9/1998 | Widen |
| 5,826,451 | A | 10/1998 | Cook |
| 6,079,240 | A | 6/2000 | Shvarts |
| 6,173,595 | B1 | 1/2001 | Hughes |
| 6,257,033 | B1 | 7/2001 | Ziv-Av |
| 6,301,942 | B1 | 10/2001 | Shvarts |
| 6,477,876 | B1 | 11/2002 | Kim |
| 6,526,791 | B2 | 3/2003 | Shvarts |
| 6,708,539 | B1 | 3/2004 | Widen |
| 6,758,073 | B2 | 7/2004 | Yu |
| 6,910,356 | B2 | 6/2005 | Price |
| 6,978,647 | B2 | 12/2005 | Edwards, Jr. et al. |
| 6,981,396 | B1 | 1/2006 | Kim |
| 7,059,160 | B2 | 6/2006 | Keller |
| 7,370,502 | B2 | 5/2008 | Widen |
| 7,634,930 | B2 | 12/2009 | Boesel et al. |
| 7,647,798 | B1 | 1/2010 | Jones et al. |
| 7,797,973 | B2 | 9/2010 | Field et al. |
| 7,810,364 | B2 | 10/2010 | Widen |
| 8,156,777 | B1 | 4/2012 | Widen |
| 8,186,194 | B2 | 5/2012 | Field et al. |
| 8,327,675 | B2 | 12/2012 | Baumann |
| 8,336,349 | B2 | 12/2012 | Thimmappa et al. |
| 8,707,746 | B1 | 4/2014 | Liu |
| 8,720,241 | B1 | 5/2014 | Widen |
| 8,776,557 | B2 | 7/2014 | Wang |
| 8,794,042 | B2 | 8/2014 | Herdman |
| 9,127,480 | B2 | 9/2015 | Mathachan |
| 9,416,561 | B2 | 8/2016 | Field et al. |
| 9,598,880 | B2 | 3/2017 | Walls et al. |
| 9,719,275 | B1 | 8/2017 | Tobias et al. |
| 10,337,210 | B2 * | 7/2019 | Widen |
| 2002/0056301 | A1 | 5/2002 | Theriault et al. |
| 2003/0136164 | A1 | 7/2003 | Widen et al. |
| 2003/0188558 | A1 | 10/2003 | Shiao et al. |
| 2009/0241620 | A1 | 10/2009 | Field et al. |
| 2010/0005842 | A1 | 1/2010 | Herdman |
| 2011/0041579 | A1 | 2/2011 | Chen |
| 2012/0240646 | A1 | 9/2012 | Herrmann |
| 2013/0312467 | A1 | 11/2013 | Liu |
| 2015/0240525 | A1 | 8/2015 | Walls et al. |
| 2016/0060901 | A1 | 3/2016 | Lundberg |
| 2017/0152678 | A1 | 6/2017 | Clifford |

FOREIGN PATENT DOCUMENTS

| | | | |
|---|---|---|---|
| WO | WO 01/48341 | A1 | 7/2001 |
| WO | WO 2012/039671 | A1 | 3/2012 |

OTHER PUBLICATIONS

International Search Report and Written Opinion of the International Searching Authority for International Application No. PCT/EP2018/084021, dated Aug. 20, 2019.

* cited by examiner

Fig 1
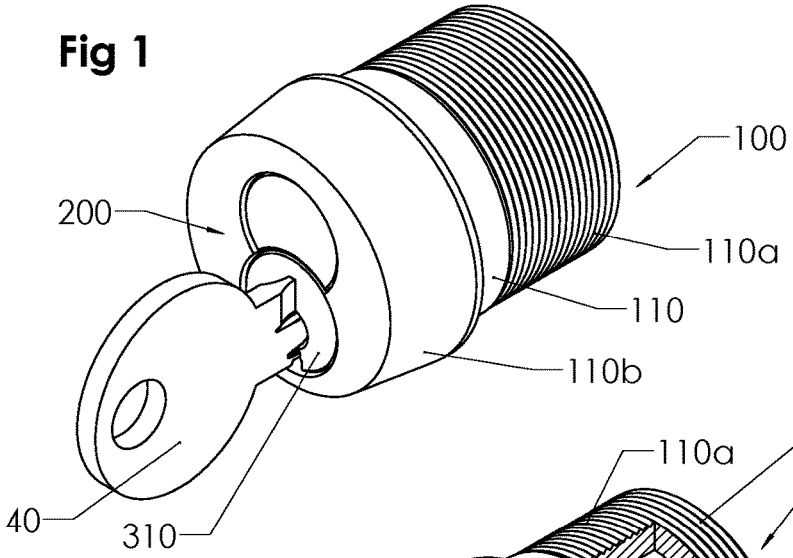
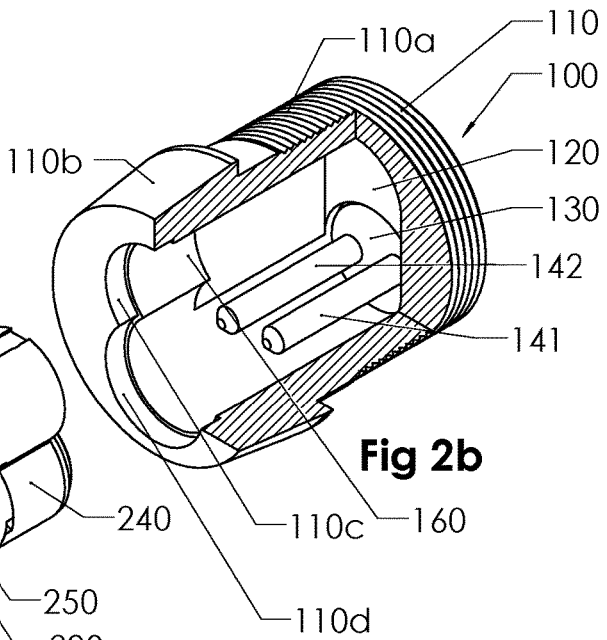
Fig 2b
Fig 2a
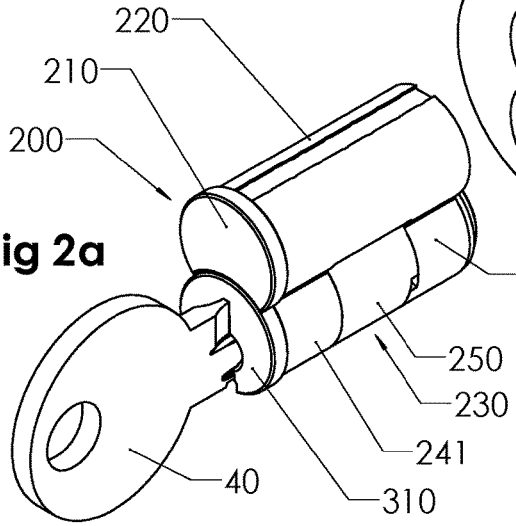
Fig 3a
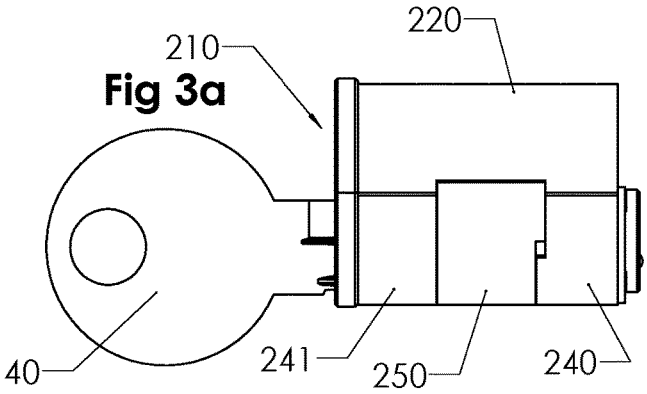
Fig 3b
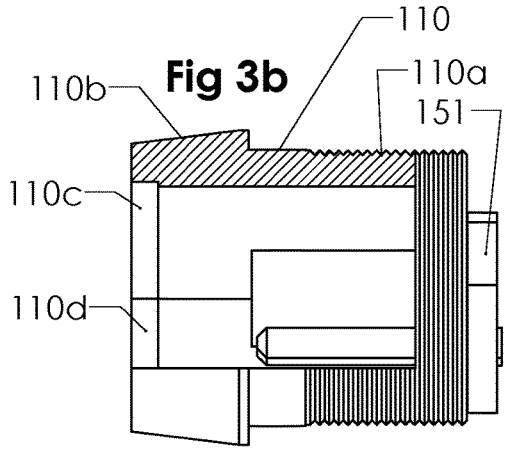

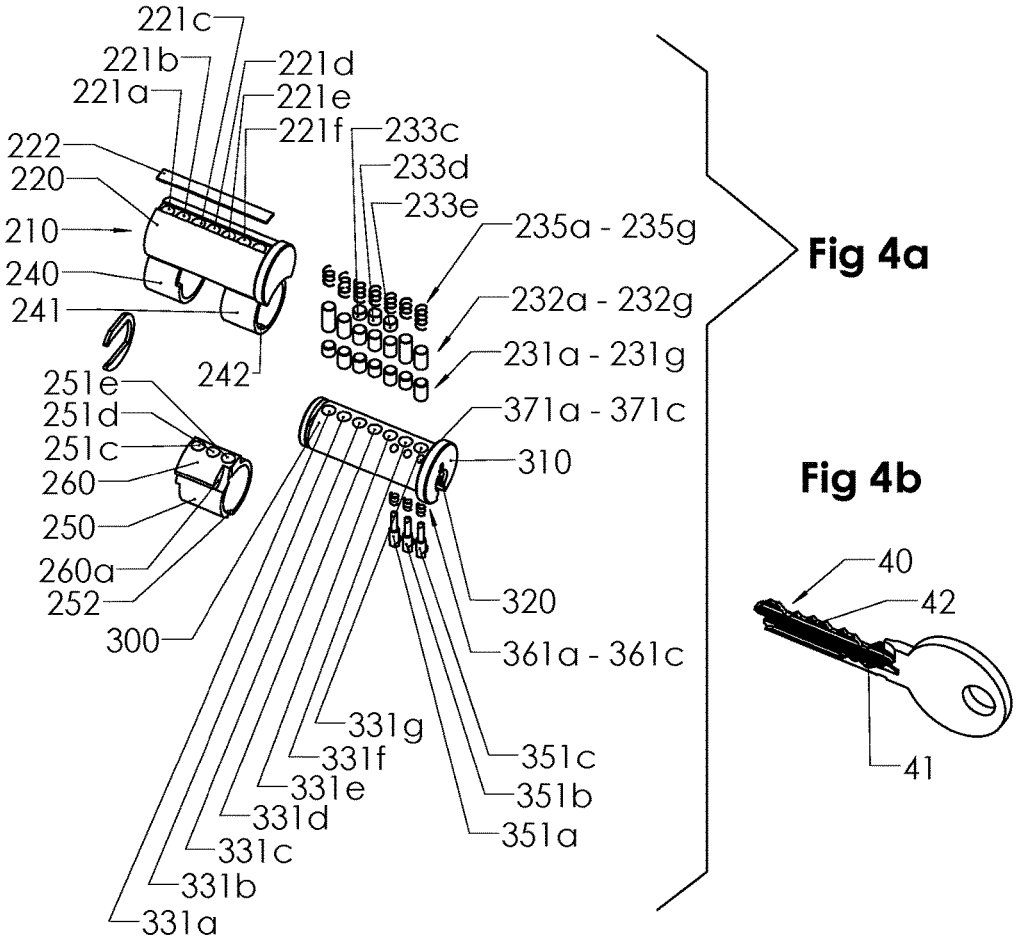
Fig 4a
Fig 4b
Fig 4c
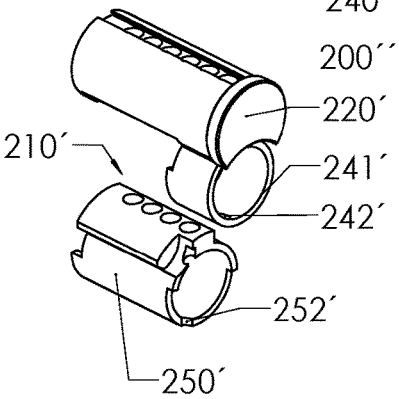
Fig 4d
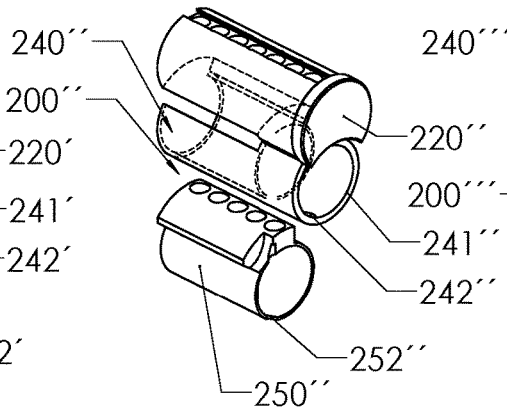
Fig 4e
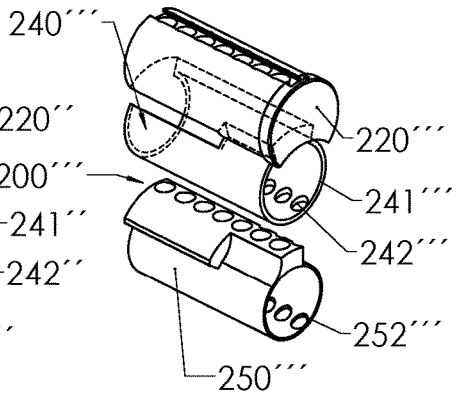

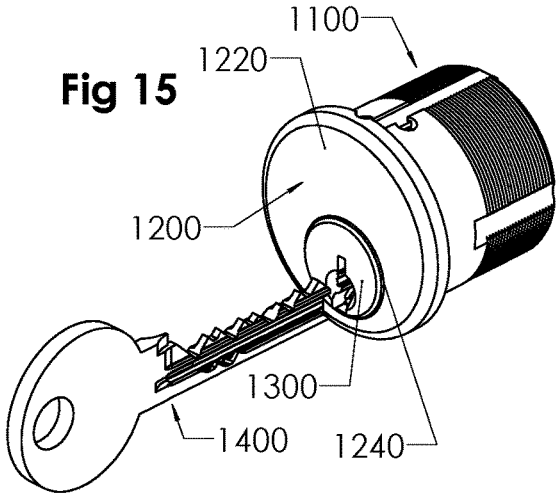
Fig 15
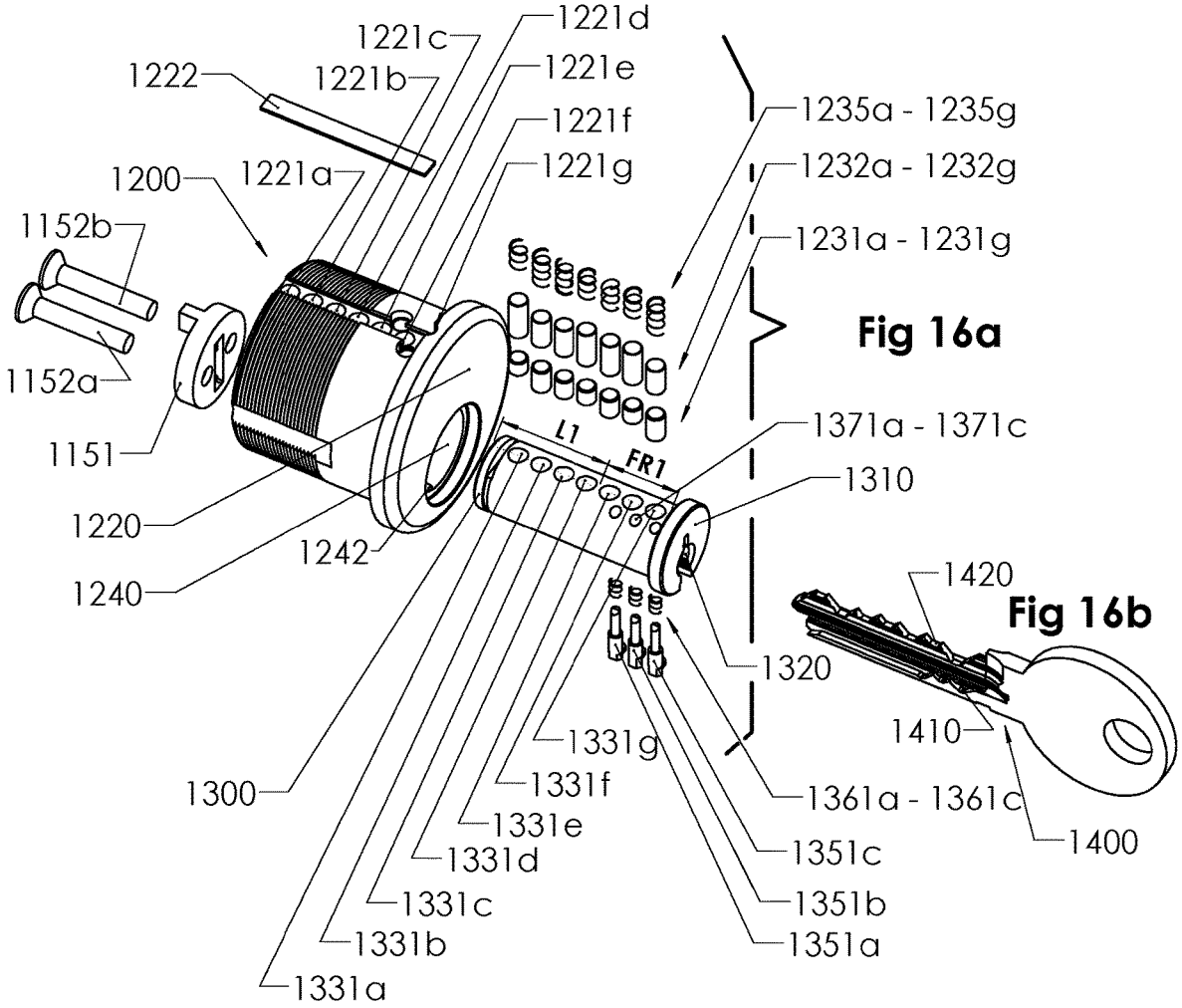
Fig 16a
Fig 16b

CYLINDER LOCK CORE FOR A CYLINDER LOCK UNIT

CROSS-REFERENCE TO RELATED APPLICATION

This Application is a Continuation-In-Part of co-pending U.S. patent application Ser. No. 15/617,779 filed on Jun. 8, 2017, which is hereby expressly incorporated by reference into the present application.

BACKGROUND OF THE INVENTION

Field of the Invention

The present invention relates to a cylinder lock unit which includes a housing or shell having an upper part and a lower part. The lower part of the housing includes a cylindrical bore accommodating a rotatable key plug. A back region of the key plug has a minimum length of 50% of a total length of the key plug with an adjoining front region having a maximum length of 50% of the total length. The front region of the key plug accommodates at least one side locking mechanism confined entirely within the front region of the key plug that includes a longitudinal row of at least two coded side locking tumblers wherein each side locking mechanism is movable independently of each other with at least three different code positions for each coded side locking tumbler and a plurality of different code combinations for the at least two coded side locking tumblers in each longitudinal row.

Discussion of the Related Art

Lock units, including those with interchangeable cylinder lock cores, are frequently used in the United States. However, prior locks have not been constructed to include a cylinder lock unit having a housing or shell with a lower part that includes a cylindrical bore accommodating a rotatable key plug with a back region of the key plug having a minimum length of 50% of a total length of the key plug with an adjoining front region having a maximum length of 50% of the total length. In addition, the prior art does not disclose the front region of the key plug as accommodating at least one side locking mechanism confined entirely within the front region of the key plug that includes a longitudinal row of at least two coded side locking tumblers wherein each side locking mechanism is movable independently of each other with at least three different code positions for each coded side locking tumbler and a plurality of different code combinations for the at least two coded side locking tumblers in each of the longitudinal row.

SUMMARY AND OBJECTS OF THE INVENTION

According to an aspect of the present invention, a cylinder lock unit includes a housing or shell having an upper part and a lower part. The lower part of the housing or shell includes a cylindrical bore for accommodating a rotatable key plug. The rotatable key plug is formed in one piece and is adapted, via a torque transferring connection, to transfer a torque to a locking mechanism when the key plug is rotated. The upper part of the housing or shell is provided with a central row of upper and lower locking pins in associated cavities. The key plug includes a central row of corresponding cavities for accommodating the lower locking pins in the central row. The key plug includes at least one side locking mechanism that is operative independently of the central row of upper and lower locking pins. A keyway extends axially backwards from a front end of the key plug and is configured to accommodate an associated key. The central row of upper and lower locking pins and the side locking mechanism is arranged to engage with and lock the key plug against rotation in the lower part of the housing or shell unless the associated key is inserted into the keyway.

According to this aspect, a back region of the key plug has a minimum length of 50% of a total length of the key plug. An adjoining front region of the key plug has a maximum length of 50% of the total length. The back region of the key plug accommodates a rear part of the central row of corresponding cavities, which cooperate with the lower locking pins of the central row of locking pins, as well as two side portions, at each lateral side of the keyway, being reserved for possibly accommodating at least one additional lock component. The front region of the key plug accommodates, on at least one lateral side of the keyway, the at least one side locking mechanism. The at least one side locking mechanism is confined entirely within the front region of the key plug. The at least one side locking mechanism includes a longitudinal row of at least two coded side locking tumblers each interacting with the lower part of the housing or shell, either directly or indirectly via a side bar. The at least two coded side locking tumblers in each side locking mechanism are movable independently of each other, there being at least three different code positions for each coded side locking tumbler and a plurality of different code combinations for the at least two coded side locking tumblers in each longitudinal row in the front region of the key plug.

According to another embodiment of the present invention, in the cylinder lock unit the longitudinal row of coded side locking tumblers in the side locking mechanism includes at least three coded side locking tumblers.

According to another embodiment of the present invention, in the cylinder lock unit the at least one additional lock component includes a part of the torque transferring connection.

According to another embodiment of the present invention, in the cylinder lock unit the part of the torque transferring connection includes at least one fastening screw.

According to another embodiment of the present invention, in the cylinder lock unit the key plug is provided with two side locking mechanisms, one on each side of the keyway.

According to another embodiment of the present invention, in the cylinder lock unit each of the coded side locking tumblers in the front region of the key plug is provided with a transverse finger being held in direct contact with a side code pattern on the associated key when the key is being inserted into the keyway.

According to another embodiment of the present invention, in the cylinder lock unit the at least two of the coded side locking tumblers are movable between a coded releasing position where they are totally confined within the key plug, and at least one locking position where they project radially outside the key plug and engages with at least one recess in the housing or shell, whereby they will prevent rotation of the key plug.

According to another embodiment of the present invention, in the cylinder lock unit the longitudinal row of coded side locking tumblers in each side locking mechanism cooperate with an associated side bar, forming a part of the side locking mechanism and is located at the cylindrical outer circumference of the key plug and is adapted to engage with an associated groove at the inside of the housing or shell, so as to prevent rotation of the key plug unless a correctly cut key is inserted into the keyway, the side bar being then seated inside the circumferential contour of the key plug.

According to another embodiment of the present invention, in the cylinder lock unit each of the coded side locking tumblers is provided with a transverse finger cooperating with a side code pattern on an associated key, and with at least one coded recess in an outside portion thereof at a distance from the transverse finger, adapted to cooperate with the side bar, so as to enable the latter to disengage from the groove at the inside of the housing or shell.

According to another embodiment of the present invention, in the cylinder lock unit the transverse finger is longitudinally displaced, along the keyway, to form a coded location, in relation to a central axis of the associated coded side locking tumbler, each locking tumbler being coded both in respect of the longitudinal displacement of the transverse finger, and the location of the at least one coded recess cooperating with the side bar.

According to another embodiment of the present invention, in the cylinder lock unit each of the coded side locking tumblers is movable up and down as well as rotationally in an associated cavity, the rotational position also forming a code.

According to another embodiment of the present invention, in the cylinder lock unit at least one of the side tumblers is positioned in front of the first cavity.

According to another embodiment of the present invention, in the cylinder lock unit the at least one side locking mechanism extends backwards from an area adjacent to the first cavity.

According to another embodiment of the present invention, in the cylinder lock unit at least one spring is disposed between two coded side locking tumblers cooperating with the side bar, there being no spring located between a coded side locking tumbler and an end of the side bar.

According to another embodiment of the present invention, in the cylinder lock unit a single spring is disposed between the two neighboring coded side locking tumblers being located closest to the front end of the key plug and cooperating with the side bar.

According to another embodiment of the present invention, in the cylinder lock unit the back region L2 of the key plug is massive except for the rear part of the central row of corresponding cavities.

According to another embodiment of the present invention, in the cylinder lock unit the coded side locking tumblers are movable in a plane which is displaced laterally in relation to the keyway.

According to another embodiment of the present invention, in the cylinder lock unit the row of locking pins in the upper part of the housing or shell includes six or seven locking pins adapted to cooperate with bittings on an edge portion of the associated key being inserted into the keyway.

According to another embodiment of the present invention, a key is provided for unlocking an associated cylinder lock unit having a rotatable cylindrical key plug having a side locking mechanism confined to a front region thereof as well as a central row of locking pins interacting with a corresponding row of cavities in the key plug, the key plug including a grip portion and a key blade. The key blade has a wave-like side code pattern consisting of a row of at least two side code portions being substantially confined to the longitudinal half of the key blade located closest to the grip portion with the wave-like side code pattern adjoining to a straight profile groove extending towards the free end of the key blade. The key blade also has an edge code pattern including a longitudinal continuous row of code portions defined by V-shaped bittings.

According to another embodiment of the present invention, the key has at least one of the code portions of the wave-like side code pattern that is located closer to the grip portion of the key than all the code portions of the edge code pattern.

According to another embodiment of the present invention, the key has the side code portions of the wave-like side code pattern that are arranged in a continuous row in the longitudinal half of the key blade.

According to another embodiment of the present invention, the key blade has a wave-like side code pattern on both sides thereof, for interaction with side locking mechanisms arranged on both sides of the key plug of an associated lock unit.

According to another embodiment of the present invention, the wave-like side code pattern is located at a wall surface of a profile groove in at least one side surface of the key blade, each of the side code portions being formed by a concavity in said wave-like side code pattern.

According to another embodiment of the present invention, the profile groove is undercut and comprises a ridge portion, where the side code portions are located.

According to another embodiment of the present invention, each of the at least two side code portions is selected from a group of possible code positions, said possible code positions including, at different vertical levels:

- a central position, corresponding to the position of an axis of a side locking tumbler when the key is fully inserted into a keyway in said associated lock unit,
- a forwardly displaced position being displaced longitudinally at an incremental distance from said central position towards said free end of the key blade, and
- a rearwardly displaced position being displaced longitudinally at an incremental distance from said central position towards said grip portion of the key,
- said central position, said forwardly displaced position and said rearwardly displaced positions each corresponding to a particular position of a transverse finger on said side locking tumbler when the key is fully inserted into the keyway of the associated lock unit.

According to another embodiment of the present invention, the V-shaped bittings of the edge code pattern are screw cut at different angles.

According to another embodiment of the present invention, a key blank is provided for producing a key, the key blank comprising a grip portion and a key blade, wherein:

- said key blade, on at least one side thereof, has a wave-like side code pattern consisting of a row of at least two side code portions being substantially confined to said longitudinal half of the key blade located closest to said grip portion, and
- said key blade also has an edge portion configured to permit the cutting of a longitudinal row of V-shaped bittings so as to form said edge code pattern on a finished key.

According to another embodiment of the present invention, the key blank has a wave-like side code pattern on both sides of the key blade.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 shows, in a perspective view, a lock unit and an inserted interchangeable cylinder lock core according to the present invention, including a key which is inserted into a key plug forming part of the interchangeable cylinder lock core;

FIGS. 2*a* and 2*b* show, in a perspective, exploded view, the interchangeable core with the key and the lock unit (with a part thereof cut away), respectively;

FIG. 3*a* shows a side view of the interchangeable cylinder lock core of FIG. 2*a;*

FIG. 3*b* shows a side view of the lock unit of FIG. 2*b*, being partially cut away to show the inside thereof;

FIG. 4*a* shows an exploded view of the various parts of a lock and key system according to the invention, including an interchangeable cylinder lock core, with a shell, a number of locking pins, a rotatable key plug, a retainer sleeve, and a side locking mechanism;

FIG. 4*b* shows a perspective view of the key of FIGS. 2*a* and 3*a*, in a perspective view from the other side;

FIG. 4*c* shows a modified version of the interchangeable core of FIG. 4*a*, including a longer retainer sleeve and a front end sleeve portion;

FIG. 4*d* shows a further modified version of the interchangeable core of FIG. 4*a*, with a front end sleeve portion being integrated with a rear end sleeve portion;

FIG. 4*e* shows another modified version of the interchangeable core of FIG. 4*a*, with a full length retainer sleeve and a surrounding fixed sleeve;

FIG. 15 shows, in a perspective view, a lock unit according to a second aspect of the present invention, including a key which is insertable into a key plug;

FIG. 16*a* shows an exploded view of the various parts of a lock and key system according to the second aspect of the present invention, including a housing or shell, a number of locking pins, a rotatable key plug, a side locking mechanism, and a key for operating the cylinder lock unit;

FIG. 16*b* shows a perspective view of the key of FIGS. 15 and 16*b*, in a perspective view from the other side;

DETAILED DESCRIPTION OF PREFERRED EMBODIMENTS

Figure 4F:
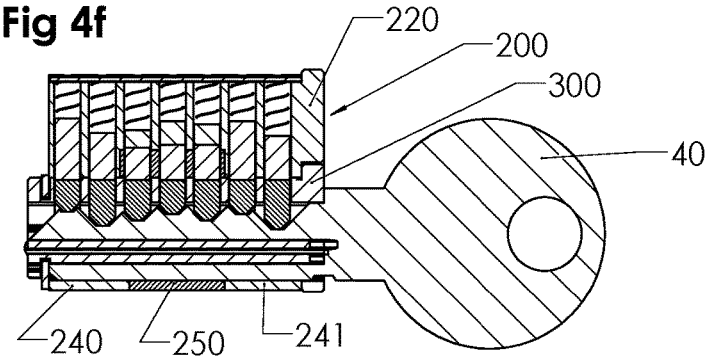
FIGS. 4*f*, 4*g*, 4*h* and 4*i* show longitudinal sections through the interchangeable cores of FIGS. 4*a*, 4*c*, 4*d* and 4*e*, respectively.

A first embodiment of the invention is shown in FIGS. 1, 2*a*, 2*b*, 3*a*, 3*b*, 4*a*, 4*b*, 4*f*, 5*a*, 5*b*, 5*c*, 5*d* and 5*e*, including a lock unit 100 and an interchangeable cylinder lock core 200 with a rotatable key plug 300 (FIG. 4*a*).

The lock unit 100 comprises a cylindrical housing 110 having a threaded rear end portion 110*a* and a slightly conical front end portion 110*b*. In a circular hole (not shown specifically) in a rear end wall 120, there is journaled a rotatable plate 130 provided with two parallel rods or prongs 141, 142, which extend in a direction towards the front end portion at the inside of the cylindrical housing 110, and a cam 151 (see FIG. 3*b*) at the back side of the rear end wall 120. The prongs 141,142 are coupled to the cam 151 via the plate 130, so that a torque can be transferred from the prongs to e.g. a door lock mechanism.

The lock unit 100 is normally permanently mounted in a door or the like in order to cooperate with a door locking mechanism, as is well known per se. The front end of the lock unit 110 is provided with a front opening 110*c*, 110*d* having the general shape of the digit "8", leading in to the interior of the housing with the rear prongs 141,142.

The interchangeable cylinder lock core 200 (see FIG. 2*a*) comprises a shell 210, also having the shape of the digit "8" and being dimensioned to fit with a slight play into the front opening 110*c*, 110*d* of the housing 110 of the lock unit 100, as will be seen in FIGS. 2*a*, 2*b* and FIGS. 3*a*, 3*b*. The shell 210 includes, in this embodiment, an upper, solid part 220 and a lower part 230 with two axially spaced hollow sleeve portions 240, 241 and a middle retainer sleeve 250 therebetween.

As will be seen from FIG. 4*a*, the upper, solid part 220 of the shell 210 has a central row of parallel cavities or holes 221*a*, 221*b*, 221*c*, 221*d*, 221*e*, 221*f* and 221*g*, the number of cavities being seven in this particular embodiment. As will be shown below, other normal embodiments are provided with six such cavities in a central row. At the upper side, a longitudinal cover plate 222 will normally cover the holes 221*a*, etc. from above and keep a corresponding number of locking pins 231*a*, etc., 232*a*, etc. and associated springs 235*a*, etc. in place.

In the hollow sleeve portions 240, 241 and the middle retainer sleeve 250, a key plug 300 is rotatably mounted. A front end wall 310 of the key plug is visible in FIGS. 1 and 2*a*, but the whole key plug is seen best in FIGS. 4*a*, 5*a*, 5*b*, 5*c* and 5*d*. The outer diameter of the cylindrical key plug is slightly smaller than the inside diameters of the sleeve portions 240,241 and the middle retainer sleeve 250, so that the key plug can rotate in relation to the shell 210. However, the possible rotary motion of the key plug is dependent on the positions of locking pins 231*a*, 231*b*, 231*c*, 231*d*, 231*e*, 231*f*, 231*g* shown in FIG. 4*a* and being movable in associated vertical cavities or holes 331*a*, 331*b*, 331*c*, 331*d*, 331*e*, 331*f*, 331*g* arranged in a central longitudinal row in the upper solid part 220 of the shell 210. These vertical holes 331*a*, etc. are located above a central keyway 320. The locking pins 231*a* etc. are held in place by associated top pins 232*a*, 232*b*, 232*c*, 232*d*, 232*e*, 332*f*, 232*g* (collectively denoted 232*a*-232*g* in FIG. 4*a*) and corresponding helical springs 235*a*, 235*b*, 235*c*, 235*d*, 235*e*, 235*f*, 235*g* (collectively denoted 235*a*-235*g* in FIG. 4*a*). In the three pin assemblies in the middle, there are also three short pins or wafers 233*c*, 233*d*, 233*e* which cooperate with the retainer sleeve 250. The latter is provided with three associated cavities or holes 251*c*, 251*d*, 251*e*, so that these short pins can be positioned exactly in these holes 251*c*, etc. to make it possible to rotate the retainer sleeve 250 by inserting a control key (not shown, denoted "first key" in the claims). When the retainer sleeve is rotated by turning such a control key, a holding lug 260 with a stop end surface 260*a* will lose its engagement with an inner shoulder 160 (FIG. 2*b*) at the inside of the housing 110 of the lock unit 100, so that the interchangeable cylinder lock 200 with its key plug 300 can be taken out as a unit (the interchangeable cylinder lock core 200, 300) from the lock unit 100.

In the normal operation of the cylinder lock, a correctly cut key 40 (denoted "second key" or just "key" in the claims) will operate the interchangeable cylinder lock 200 so as to rotate the key plug 300 and turn the rear cam 151 by means of the prongs 141,142 (see also FIG. 5*e*), which are securely guided within associated prong holes 341, 342 (FIG. 5*d*) in the key plug 300. The diameter d1 of the prongs is normally about 3.2 mm, and the inner diameter d2 of the prong holes are normally about 3.4 mm, leaving a slight radial play of 0.1 mm therebetween.

In accordance with the present invention, the two prong holes should both have a minimum length L1 (see FIG. 5*d*), preferably the same length, of at least half of the length (L1+FR1) of the key plug, corresponding to about 4 times the diameter d2 of each prong hole 341,342. Then, it has turned out that the prongs 141, 142 will be effectively guided when the interchangeable cylinder lock core is inserted into the housing of the lock unit and that, during use, the two prongs will be securely engaged in the prong holes when the key plug Is being rotated while transferring a torque for operating the lock. So, it is important that there are two prong holes having such a minimum length L1 in the back region of the key plug.

Also, the key plug is provided with an auxiliary side locking mechanism which is located on at least one lateral side of the keyway 320 and which is confined entirely within a front region FR1 located longitudinally in front of and adjoining the prong holes 341,342 (see FIGS. 5*a*, 5*b*, 5*c*, 5*d*, 5*e*). Preferably, this front region FR1 is substantially solid, except for the keyway, the cavities for the locking pins and any recesses and holes for accommodating the side locking mechanism itself. According to the invention, the side locking mechanism should comprise at least two independently movable side locking tumblers providing a high security mechanism with at least three different code positions for each locking tumbler and a plurality of different code combinations for the side locking tumblers. In the embodiment described above, see FIG. 4*a*, 4*f*, 4*k*, 5*a*, 5*b*, 5*c*, 5*d* and 5*e*, the side locking mechanism includes three locking tumblers 351*a*, 351*b*, 351*c* which are arranged in a row at one side of the keyway 320 of the key plug 300, in the solid front region thereof. This front region FR1 is generally defined as a region located in front of and adjoining the back region with the prong holes 341,342. The three locking tumblers are located entirely within this front region and also radially inside the fixed front sleeve portion 241. This location of the side locking mechanism 351*a*, 351*b*, 351*c* has the advantage that it will interact mainly with the fixed front sleeve portion 241, in associated recesses or holes 242, next to the front end 310 of the key plug 300. Other embodiments are possible, as will be described below.

The three side locking tumblers 351*a*, 351*b*, 351*c* are biased by springs 361*a*, 361*b*, 361*c* (collectively denoted 361*a*-361*c* in FIG. 4*a*) in associated vertical cavities or holes 371*a*, 371*b*, 371*c* (collectively denoted 371*a*-371*c* in FIG. 4*a*) at some lateral distance from the keyway 320 so as to project into the keyway with a projecting finger (visible in FIG. 5*b*) which will cooperate with a wave-like side code pattern 41 on the key blade of the key 40. When the key 40 is inserted into the keyway 320, the locking tumblers 351*a*, etc. will move up and down in response to their contact with the side code pattern 41. The lower ends of the tumblers

351*a*, etc. will then interact with the associated recesses or holes 242 in the fixed sleeve portion 241. At the same time, the bittings of the upper edge portion 42 of the key 40 will interact with the central row of locking pins 231*a*, etc. Only when all of the locking pins 231*a*, etc. and the three side locking tumblers 351*a*, etc. are correctly positioned, totally within the circumference of the key plug 300, will it be possible to turn the operating key 40 (the "second key") so as to open the cylinder lock.

It is important that the side tumblers 351*a*, etc. are movable independently of the central locking pins 231*a*, etc. Thus, if the cylinder lock is manipulated with a so called "bumping" technique, it may be possible to position all the locking pins 231*a*, but it will be much more difficult to simultaneously manipulate the locking tumblers 351*a*, etc. into their respective coded positions. Thus, the side locking mechanism 351 will provide a high security for the cylinder lock core.

Figure 4G:
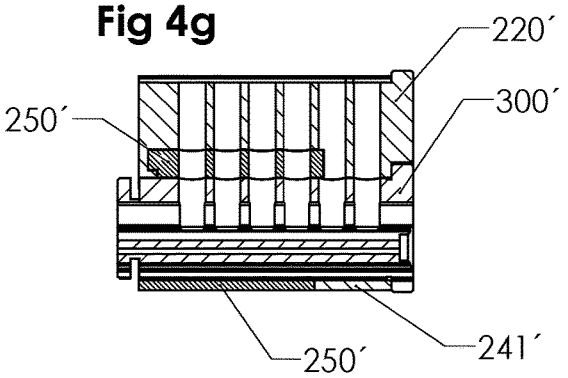

As a modification of the first embodiment described above, as shown in FIGS. 4*c* and 4*g*, the retainer sleeve 250' may extend along the inside of the lower part of the shell 210 all the way from the back end of the key plug 300 to a location at a distance from the front end thereof. In such an embodiment, the lower, fixed part of the shell 210' may be constituted by a front sleeve portion 241', which is similar to the front sleeve portion 241 in FIG. 4*a* and is provided with lower recesses or holes 242'. The fixed front sleeve portion 241' may have the same longitudinal length as the fixed front sleeve portion 241 or it may be shorter, possibly corresponding to a relatively short front region FR3 (see FIG. 9*h*) of the key plug. The rotatable retainer sleeve 250' may be relatively long, but in this embodiment, it will make room for a fixed front sleeve portion 241'. In this embodiment, there are six central pins and six associated central holes, and the wall thickness of the fixed front sleeve portion 241' is large enough to accommodate the recesses or holes 242' which interact with the side locking tumblers 351*a*, etc. of the side locking mechanism in the key plug.

Figure 4H:
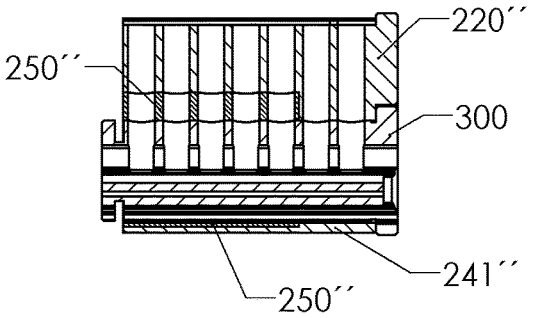

A further modification of the first embodiment shown in FIG. 4*a* is illustrated in FIG. 4*d* and FIG. 4*h*. Here, the fixed front end sleeve portion 241" has a relatively thick cylindrical wall (e.g. the same as in FIG. 4*a* and FIG. 4*c*) with recesses or holes 242" but is integrated, preferably in one piece, with a fixed rear end sleeve portion 240" having a smaller radial thickness in its cylindrical wall. The relatively long rotatable retainer sleeve 250" is mounted radially inside the fixed rear end sleeve portion 240" and also has a thin cylindrical wall, so that its interior bore has the same diameter and is aligned with the interior bore of the fixed front end sleeve portion. In this embodiment as well, the retainer sleeve can be rotated or turned in relation to the lower part of the shell with its fixed front and rear end portions. The front region of the key plug is confined longitudinally within the front end sleeve portion 241" having a relatively thick cylindrical wall.

Figure 4I:
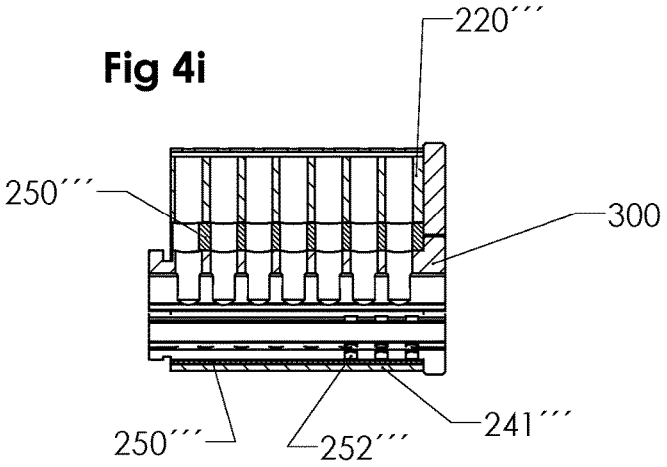

Another embodiment is shown in FIGS. 4*e* and 4*i*, where the rotatable retainer sleeve 250'" as well as the surrounding fixed sleeve 241'" both have the same length as the key plug 300, with seven central pins and associated central holes, and have rather thin cylindrical walls, the retainer sleeve 250'" being rotatable inside the fixed sleeve 241'". Both of these sleeves are provided with lower holes or recesses 242'" and through-going holes 252'", respectively, interacting with the side locking tumblers 351*a*, etc. of the key plug.

Figure 4K:
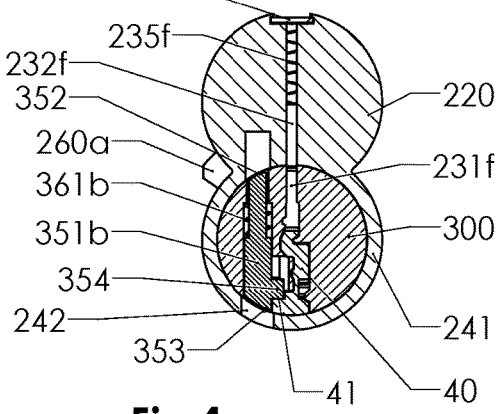
FIG. 4*k* shows a cross-section through the interchangeable core of FIG. 4*a*, at the location of a side locking tumbler.

The interaction between the side locking tumbler 351*b* of the key plug 300 and the surrounding sleeve portions is illustrated further in the FIGS. 4*k* through 4*q*, where FIG. 4*k* shows the embodiment of FIG. 4*a*, and the other FIGS. 4*l* through 4*q* show the embodiment of FIG. 4*e* and FIG. 4*i*.

In FIG. 4*k*, the side locking tumbler 351*b* is located in its totally retracted position within the key plug, where both of its ends are located at the shear line between the key plug 300 and the surrounding fixed sleeve portion 241, and the central pin 231*f* is also located with its upper end being located flush with the shear line. In this position, the key plug can be rotated or turned, provided that all other central pins and side locking tumblers are also confined within the key plug. It can also be seen that the stop end surface 260*a* of the holding lug 260 of the retaining sleeve 250 projects into its retaining, projecting position, so that the whole interchangeable cylinder lock 200, 300 is securely retained within the lock unit.

Figure 4L:
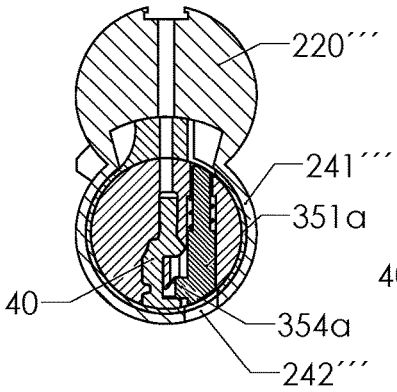
FIGS. 4*l*, 4*m* and 4*n* show cross-sections through the interchangeable core and a side locking tumbler (at the other side of the keyway) being coded in three different ways.
Figure 4M:
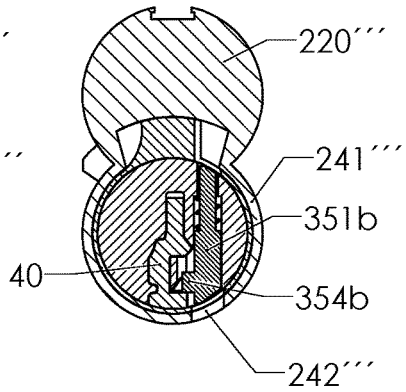
Figure 4N:
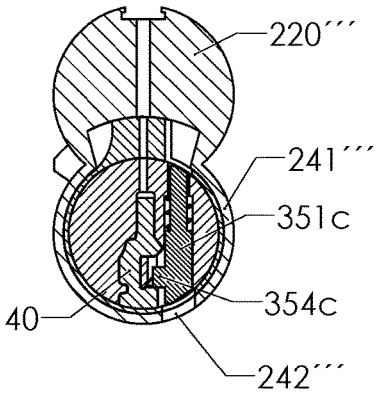
Figure 4O:
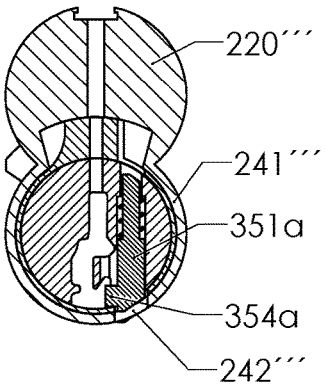
FIGS. 4*o*, 4*p* and 4*q* show the same cross-sections as in FIGS. 4*l*, 4*m* and 4*n* after withdrawal of the key from the keyway.
Figure 4P:
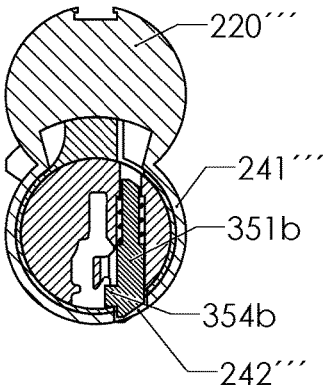
Figure 4Q:
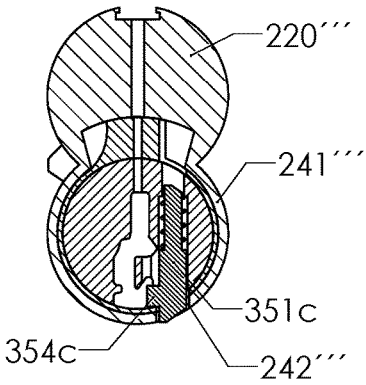

The FIGS. 4*l*, 4*m* and 4*n* show three differently coded side locking tumblers 351*a*, 351*b* and 351*c*, where the transversally projecting fingers 354*a*, 354*b* and 354*c* are located at three different heights above the lower ends of the tumblers. This will have the consequence that when the key is withdrawn from the keyway, the lower ends of the side locking tumblers 351*a*, 351*b*, 351*c* will fall down to three different levels in the holes 242'" in the fixed sleeve 241'", as illustrated in FIGS. 4*o*, 4*p* and 4*q*. Since each side locking tumbler 351*a*, 351*b*, 351*c* has three possible codes, in this example, the total number of codes for the side locking mechanism will be 3×3×3=27 in this case.

A number of embodiments of the side locking mechanism in the interchangeable cylinder lock core according to the invention will now be described.

In FIGS. 5*a*, 5*b*, 5*c*, 5*d*, 5*e*, the basic (first) embodiment of FIGS. 4*a*, 4*f* and 4*k* is shown, with three side locking tumblers 351*a*, 351*b*, 351*c* in a longitudinal row in associated holes 371*a*, 371*b*, 371*c* on one lateral side of the keyway 320, as described above.

Figure 6:
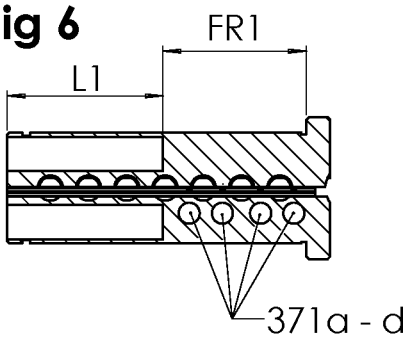
FIG. 6 shows a key plug of a similar embodiment as in FIG. 5*d*, but with four side locking tumbler holes in a row.

In a modified version of the first embodiment, as shown in FIG. 6, there are four side locking tumblers in a longitudinal row, in associated holes 371*a*, 371*b*, 371*c*, 371*d*. The back end L1 and the front end FR1 of the key plug are just as long as in the previous embodiment, and the prong holes are also exactly the same.

In a second embodiment, illustrated in FIGS. 7*a*, 7*b*, 7*c* and 7*d*, the structure is similar to the first embodiment (all the reference numerals starting with the digit 4 instead of 3), but here there is a row of side locking tumblers on each side of the keyway 420, each such row consisting of two independently movable side locking tumblers 451*a*, 451*b* and 461*a*, 461*b*, respectively. Each side locking tumbler will interact with the surrounding fixed sleeve portion (not shown) in the same way as shown in FIGS. 4*l* to 4*q*. Thus, there are four side locking tumblers which are movable independently of each other, each in at least three elevational positions. So, the number of possible code combinations will be even higher in this embodiment (at least 3×3×3×3=81).

Figure 5A:
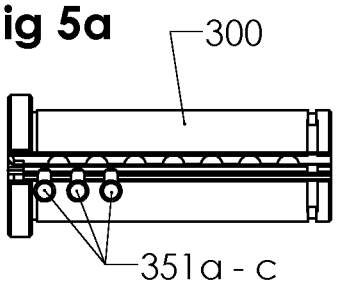
FIGS. 5*a*, 5*b*, 5*c* and 5*d* show the key plug of FIG. 4*a*, in views from below, from the front end, from above and in a longitudinal section, respectively.
Figure 5B:
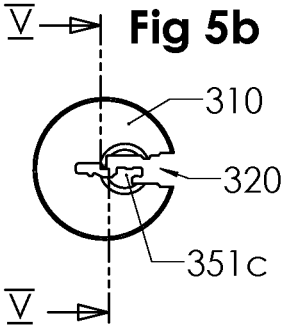
Figure 5C:
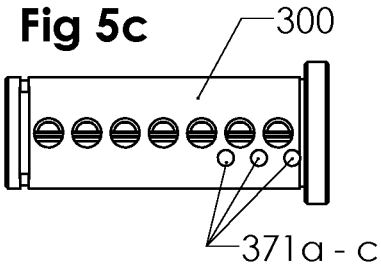
Figure 5E:
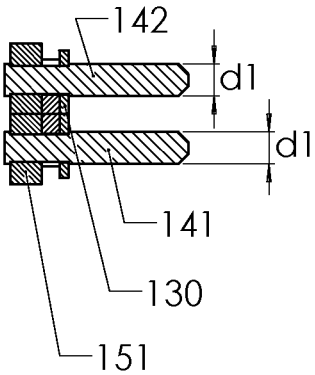
FIG. 5*e* shows the prongs of the lock unit.
Figure 5D:
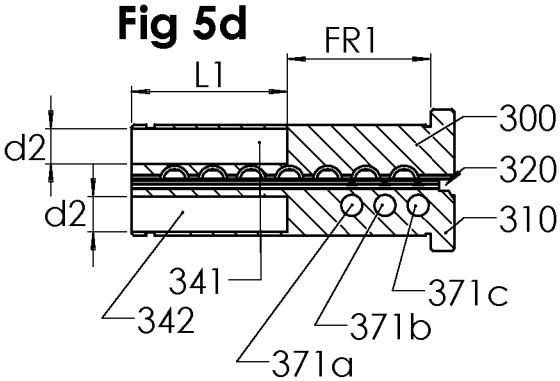

The back end L2 of the key plug 400 is somewhat longer in this second embodiment, and the front end FR2 is shorter (the total length L2+FR2 being the same as in FIG. 5*d*).

Figure 7A:
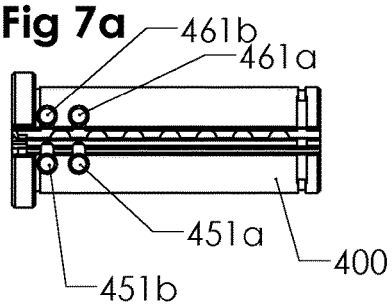
FIGS. 7*a*, 7*b*, 7*c* and 7*d* show a key plug of a second embodiment which is similar to the one of FIGS. 5*a* to 5*d*, but with a shorter side locking mechanism on each side of the key plug, with two locking tumblers in each side locking mechanism.
Figure 7B:
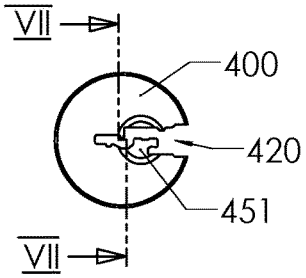
Figure 7C:
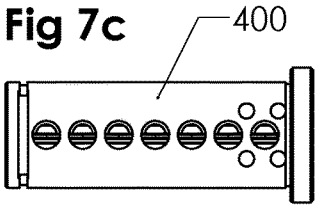
Figure 7D:
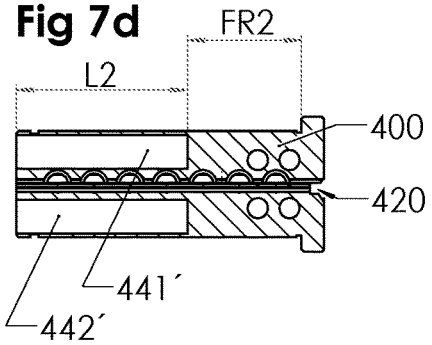
Figure 8A:
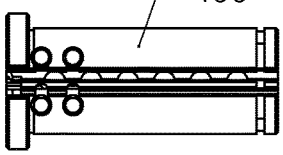
FIGS. 8*a*, 8*b*, 8*c* and 8*d* show a key plug of a modified embodiment which is similar to the one of FIGS. 5*a* to 5*d*, but with only six locking pins (instead of seven locking pins in the previous embodiments) and two side locking tumblers on each side of the key plug.
Figure 8B:
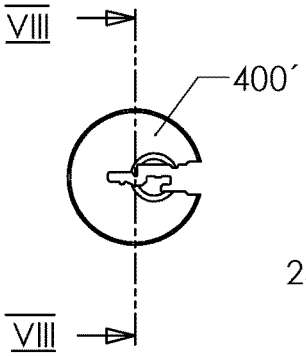
Figure 8C:
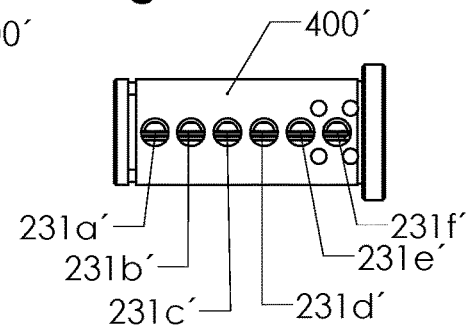
Figure 8D:
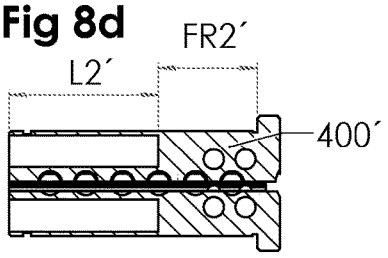

In a modified version of the second embodiment, shown in FIGS. 8*a*, 8*b*, 8*c* and 8*d*, the structure is exactly the same as in the one shown in FIG. 7*a*, etc., except that the number of central locking pins 231*a*', . . . 231*f*' (FIG. 8*c*) in the key plug 400 is six rather than seven and the total length of the key plug is a little shorter. Still, the length L2' of the prong holes is slightly more than half of the length of the key plug.

Figure 9A:
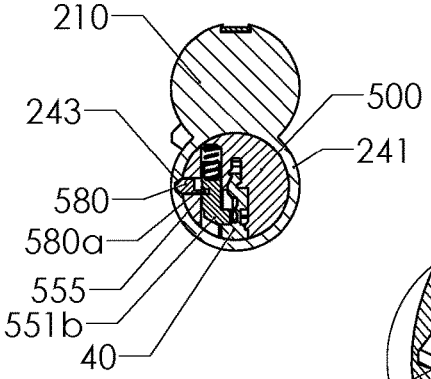
FIGS. 9*a*, 9*b*, 9*c*, 9*d*, 9*e*, 9*f*, 9*g* and 9*h* show, in various views, a third embodiment having two longer prong holes and a side locking mechanism provided with a side bar which cooperates with two side locking tumblers on one lateral side of the keyway.
Figure 9B:
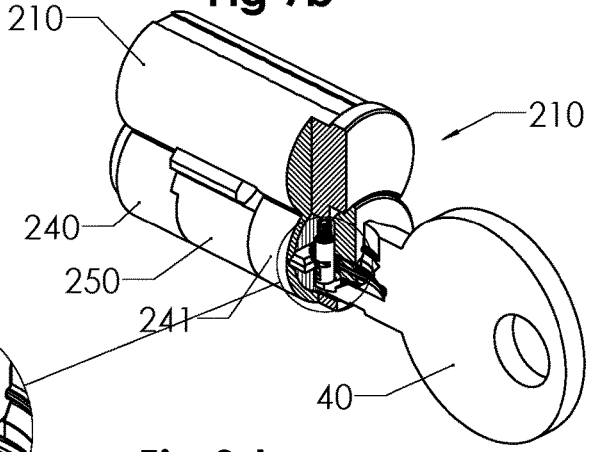
Figure 9C:
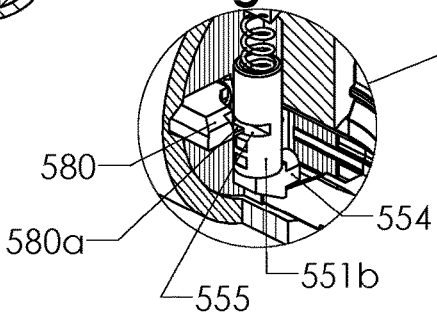
Figure 9D:
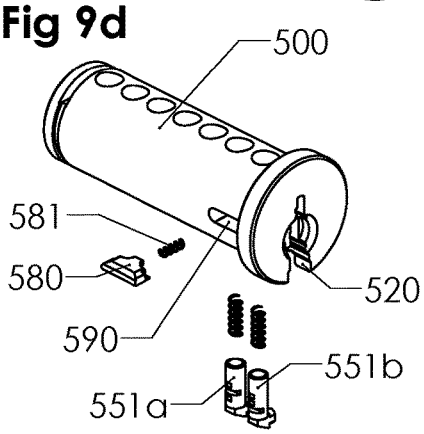
Figure 9E:
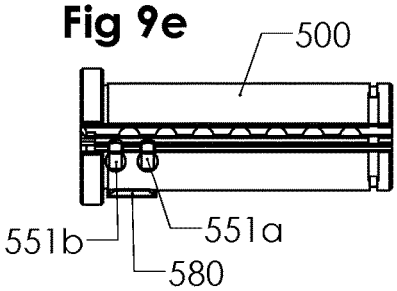
Figure 9F:
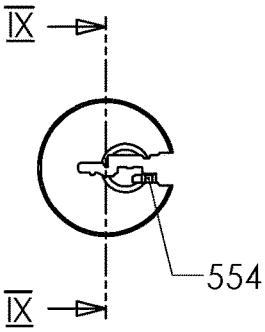
Figure 9G:
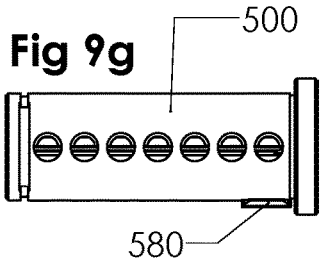
Figure 9H:
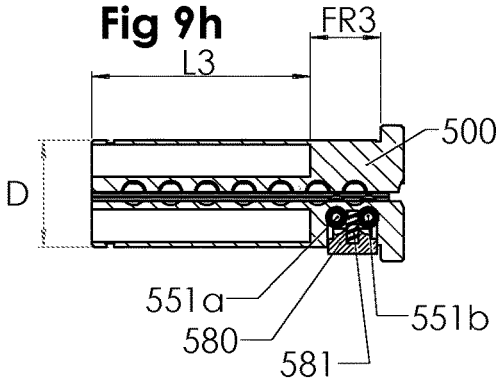

In a third embodiment, shown in FIGS. 9, 9*a*, 9*b*, 9*c*, 9*d*, 9*e*, 9*f*, 9*g*, 9*h* and FIG. 10, the number of central locking pins is again seven, like in most of the previous embodiments, but the side locking mechanism is different, with only two side locking tumblers, on one side of the key plug 500 only, these two side locking tumblers 551*a*, 551*b* cooperating with a relatively short side bar 580 (FIG. 9*d*). Such a side locking mechanism with a side bar is known per se, but not in the context of interchangeable cylinder lock cores having two relatively long prong holes. The side bar 580 is normally held in a longitudinal recess or groove 243 (see FIG. 9*a*) by a spring 581 (see FIG. 9*d*), located between the two side locking tumblers to save longitudinal space, in a position where it projects sideways outside the contour of the key plug 500. In this position, the side bar will register with the corresponding groove 243 in the front end sleeve portion 241 of the shell 200 and thereby effectively lock the key plug against rotation. However, when the side locking tumblers 551*a* and 551*b* are positioned in certain vertical positions, by means of the properly cut key 40, the side bar 580 can be moved sideways, against the action of the spring 581, into a retracted position where it is no longer seated in the groove 243. Thus, by turning the key 40, the side bar 580 will be retracted and permit rotation of the key plug 500. Then, a projecting lug 580*a* will find its way into a coded recess 555 in the cylindrical surface of the side locking tumbler 551*b*. This interaction will be seen clearly in the enlarged view in FIG. 9*c*, which also shows how the transverse finger 554 of the side locking tumbler 551*b* will be lifted to the right position by the side code pattern on the key 40. By way of the side bar, the side locking mechanism will provide a high degree of security, since it is difficult to manipulate the side locking tumblers 551*a*, 551*b* so as to release the lock. In this embodiment, with only two side locking tumblers in a row, the back region of the key plug 500 may have a greater length L3, as shown in FIG. 9*h*, leaving only a relatively short front region FR3.

Figure 10:
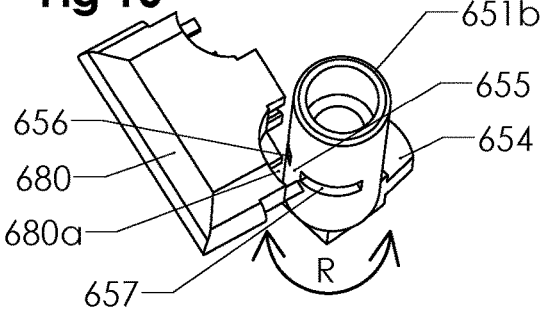
FIG. 10 shows a modified embodiment of the side locking mechanism having a side bar interacting with side locking tumblers which are movable up and down and also rotatable around their own axes.
Figure 11:
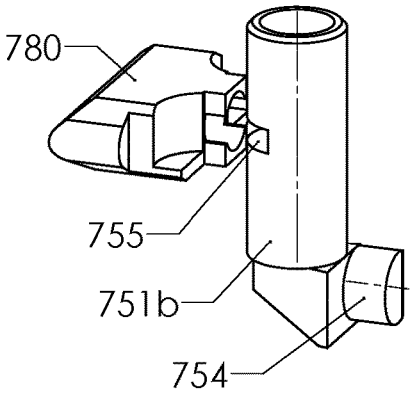
FIG. 11 shows another modified embodiment where the side locking tumblers are each provided with a longitudinally displaced finger.
Figure 12A:
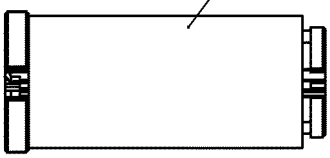
FIGS. 12*a*, 12*b*, 12*c* and 12*d* show, in views corresponding to FIGS. 5*a*, 5*b*, 5*c* and 5*d*, respectively, an embodiment having three side locking tumblers interacting with a sidebar, on one lateral side of the keyway.
Figure 12B:
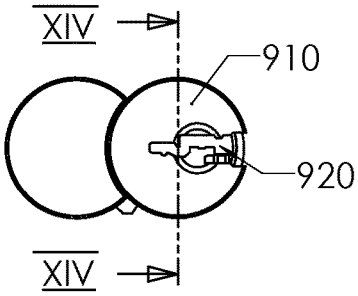
Figure 12C:
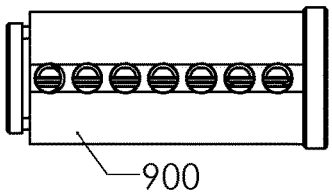
Figure 12D:
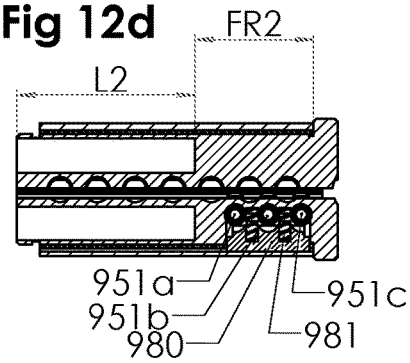
Figure 13A:
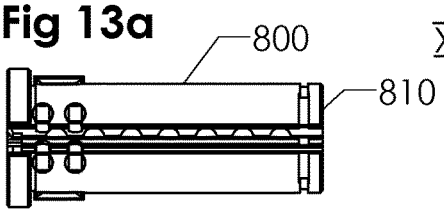
FIGS. 13*a*, 13*b*, 13*c* and 13*d* show, in views also corresponding to FIGS. 5*a* to 5*d*, a fourth embodiment with two side bars, one on each lateral side of the keyway of the key plug.
Figure 13B:
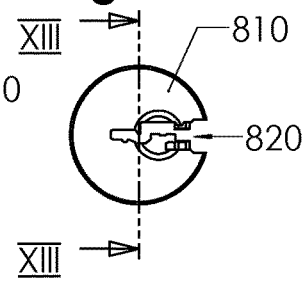
Figure 13C:
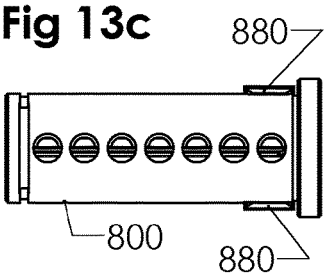
Figure 13D:
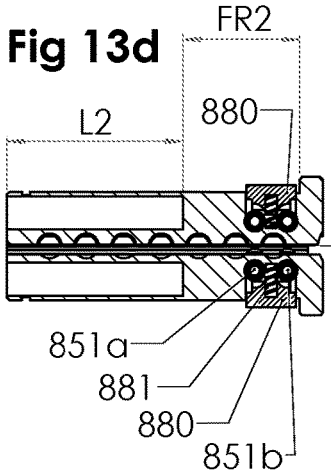

As shown in FIGS. 10 and 11, each side locking tumbler can interact in different ways with the side bar, either by way of rotating along its axis or being non-rotatable and having a longitudinally displaced finger. In FIG. 10, the side locking tumbler 651*b* can rotate between two rotary end positions, as indicated by the arrow R. A material portion 655, between two adjacent recesses 656,657 in the cylindrical surface of the side locking tumbler can fit into a corresponding slot 680*a* in the side bar 680. With two or three rotary positions and three or more levels of the coded recesses 656, 657, the code combinations for each locking tumbler 651*b* will be 6 or higher. In this case, the code pattern at the side of the key must be configured to accommodate for two or three different pivotal positions of the transverse finger 654.

Similarly, in FIG. 11, the transverse finger 754 of the side locking tumbler 751*b*, is longitudinally displaced (along the longitudinal axis of the keyway of the key plug) into one of three coded positions. Accordingly, with several possible levels of the recesses 755 at the cylindrical surface of the tumbler, there will also be a large number of code combinations for each side locking tumbler, e.g. 9 or higher.

In a modified version of the third embodiment, shown in FIGS. 12*a*, 12*b*, 12*c*, 12*d*, there are three side locking tumblers 951*a*, 951*b*, 951*c* (on one side of the keyway 920 of the key plug 900) which interact with a somewhat longer side-bar 980, biased by springs 981.

In a fourth embodiment, shown in FIGS. 13*a*, 13*b*, 13*c* and 13*d*, there are two relatively short side locking mechanisms 880, one on each side of the keyway 820, adjacent to the front end 810 of the key plug 800. This is a favorable embodiment with a very high number of code combinations and yet a compact structure confined within a rather small part (less than 20%) of the total length of the key plug 800. The back region has a relatively long length L2 and the front region is relatively short, with length FR2, but if necessary, the front region of the key plug may be just as short as in the embodiment shown in FIG. 9*h* (FR3).

Figure 14A:
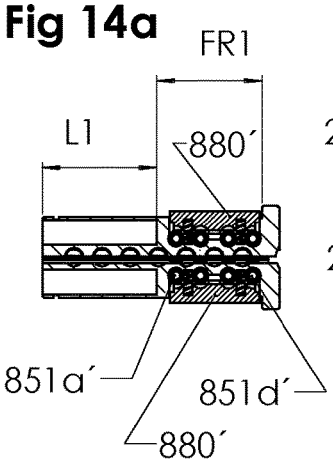
FIGS. 14*a*, 14*b*, and 14*c* show, in views corresponding to FIGS. 5*d*, 4*d* and 4*a*, respectively, some further embodiments with a longer side bar on each lateral side of the keyway, each cooperating with four side locking tumblers in a row.
Figure 14B:
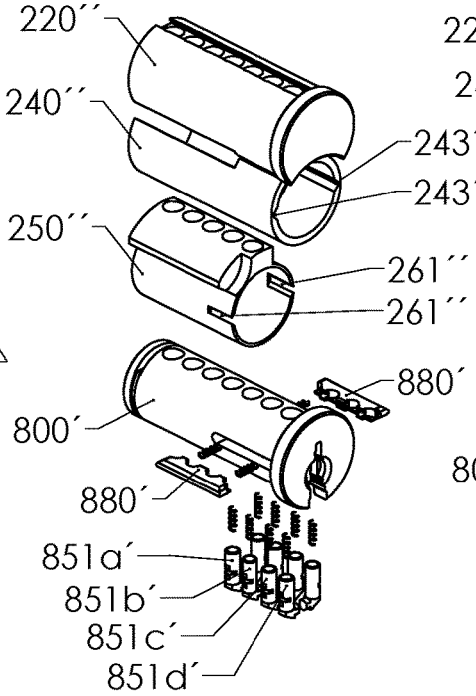
Figure 14C:
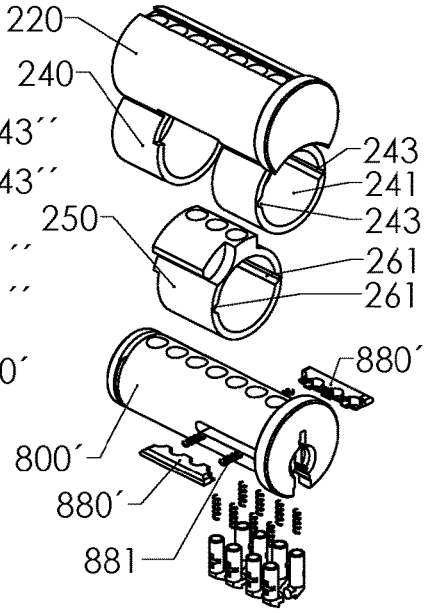

Finally, a fifth embodiment is shown in FIGS. 14*a*, 14*b* and 14*c* where the key plug 800', in its solid front end region FR1, is provided, on each side of the keyway, with a row of four side locking tumblers 851*a*', 851*b*', 851*c*', 851*d*' cooperating with an associated side bar 880'. Here, since the side locking mechanisms are arranged on both lateral sides of the keyway, each with four side locking tumblers in a row, the result will be a very large number of code combinations.

FIGS. 14*b* and 14*c* show the two possible shell structures for the fifth embodiment. In FIG. 14*b*, the shell structure is similar to the one shown in FIG. 4*d*, with an extra slot 261" on both sides of the retainer sleeve 250" for accommodating a rear end portion of the side bar 880' when the latter is located in its locking position where it is seated in the respective groove 243" in the lower fixed sleeve 240". In FIG. 14*c*, the structure is similar to FIG. 4*a*, with a rotatable retainer sleeve 250 situated between fixed rear and front end sleeve portions 240, 241. Here, there are also grooves 243 and 261 interacting with the side-bars 880'.

The side-bars shown in FIGS. 9*a* to 9*h*, 10, 11, 12*d*, 13*d* and 14*a* to 14*c* are very favorable in that the springs (e.g. 581 in FIG. 9*d*), which push the side-bar radially outwardly, are each located between a pair of side locking tumblers, so that the end of the side-bar can be positioned very close to the front end of the key plug, thereby saving space.

Also, in all embodiments, the hole (e.g. 371*c*) for the side locking tumbler (e.g. 351*c*) being located closest to the front end of the key plug is located closer to the front end than all the central holes (e.g. 331*a*-331*g*), whereby the space for the side locking mechanism is utilized efficiently, and there is consequently room for at least two and possibly three or four side locking tumblers in a row in the front region FR1, FR2, FR3 which is at the most half of the total length of the key plug.

The associated key 40, having a wave-like side code pattern 41 (see FIG. 4*b*) with code portions interacting with the side locking tumblers, will have the entire side code pattern 41 located substantially within the half of the key blade being located closest to the grip portion of the key. Furthermore, the side code portion of this pattern 41 located closest to the grip portion will be located closer to the grip portion than all the V-shaped bittings 42 on the edge of the key, the latter bittings interacting with the central row of locking pins of the cylinder lock. In this way, these keys 40 will be distinguished from all prior art keys.

As illustrated in FIGS. 1-14*c*, an interchangeable cylinder lock core (200) is provided with a rotatable cylindrical key plug (300; 300; 400'; 500; 800; 800'; 900) for use together with a lock unit (100) having a housing (110) dimensioned to receive the interchangeable cylinder lock core. A torque transferring mechanism is provided in the housing adapted to transfer a torque to the lock unit when the key plug is rotated. The torque transferring mechanism may include two longitudinal prong holes (341, 342; 441', 442') that extend from the back end of the key plug (300) for receiving two longitudinal prongs (141, 142). In the alternative, the torque transferring mechanism may be a projection extending from the rotatable plate 130 that is received in an aperture in the back end of the key plug (300) to transfer the torque of the lock unit when the key plug is rotated.

A shell (210) is provided having an outer contour dimensioned to fit into the housing (110). The shell includes an upper part (220, 220', 220"; 220'"), provided with a central row of locking pins (231*a*, . . . , 231*g*) in associated cavities (221*a*, . . . , 221*g*), and a lower part (230) with a cylindrical bore accommodating the rotatable key plug, at least a part of the cylindrical bore extending through a rotatable retainer sleeve (250). The rotatable key plug is also provided with a central row of associated cavities (331*a*, . . . , 331*g*) cooperating with the locking pins. In addition, the rotatable retainer sleeve is provided with holes (251*c*, 251*d*, 251*e*) corresponding to the cavities (331*a*, 331*b*, 331*c*) for the locking pins and also is provided with an engaging member (260), adapted to releasably retain the interchangeable cylinder lock core in the housing, and to enable removal and replacement of the interchangeable cylinder lock core in relation to the housing (110) of the lock unit.

The key plug (300; . . . ; 900) is rotatable in the cylindrical bore and includes a back region (L1; L2; L3) extending from a back end, and a front region (FR1; FR2, FR3), which adjoins the back region and extends up to a front end (310) of the key plug. A keyway (320, 420, 520) extends from the front end axially along the key plug and is configured to accommodate an associated key (40).

The central row of locking pins (231*a*, . . . , 231*g*) is arranged to engage with and lock the key plug (300; . . . ; 900) against rotation in the lower part of the shell (200, 200') unless the associated key (40) is inserted into the keyway.

The adjoining front region (FR) of the key plug accommodates, in addition to the central row of locking pins, at least one side locking mechanism (351*c*, 351*b*, 351*a*; 451*a*, 451*b*, 461*a*, 461*b*; 551*a*, 551*b*, 580, 851*a*'-851*d*', 880'; 951*a*, 951*b*, 951*c*, 980) on at least one lateral side thereof so as to engage with an inner circumferential surface of a fixed front end sleeve portion (241; 241'; 241"; 241'"), which forms a portion of the lower part (230) of the shell. The at least one side locking mechanism (351*c*, 351*b*, 351*a*) is operative independently of the central row of locking pins (231*a*, 231*b*, 231*c*). In addition, the at least one side locking mechanism includes a longitudinal row of at least two coded side locking tumblers (351*a*, 351*b*, 351*c*) which are each movable independently of each other, there being at least three different code positions for each coded side locking tumbler and a plurality of different code combinations for the at least two side locking tumblers in the longitudinal row.

As illustrated in FIGS. 4*a*, 5*a*, 5*c*, 5*d*, 6, 7*a*, 7*c*, 8*a*, 8*c*, 8*d*, 9*e*, 9*h*, 12*d*, 13*a*, 13*c* and 14*a*, at least one of the coded side locking tumblers (351*c*, 371*c*, 371*d*, 451*b*, 461*b*, 551*b*, 951*c*, 851*b*, 851*d*') is located in front of the first one (331*g*, 231*f*') of the associated cavities (331*a*, . . . , 331*g*; 231*a*' . . . , 231*f*') disposed adjacent to the front end (310) of the key plug.

As illustrated in FIG. 2*a*, the rotatable retainer sleeve (250) is arranged between the fixed front end sleeve portion (241) and a rear end sleeve portion (240), the sleeve portions defining the cylindrical bore together with the rotatable retainer sleeve. As illustrated in FIGS. 4*c*-4*e*, the rotatable retainer sleeve (250'; 250"; 250'") extends from the back end of the key plug (300) up to the fixed front end sleeve portion (241, 241', 241", 241'"). The rotatable retainer sleeve (250"; 250'") has a thinner cylindrical wall than the fixed front end sleeve portion (241"; 241'") and the fixed front end sleeve portion (241") is integrated with a rear end sleeve portion (240"; 240'") having a thinner cylindrical wall than the front end sleeve portion (241"; 241'"), the rear end sleeve portion (240" "; 240'") being located radially outside the rotatable retainer sleeve (250"; 250'") such that the retainer sleeve (250"; 250'") and the front end sleeve portion (241"; 241'") define the cylindrical bore.

As illustrated in FIG. 2*b*, the rotatable retainer sleeve (250) has a holding lug adapted to engage, upon insertion of the interchangeable cylinder lock core into the lock unit (100), with a recess having a shoulder (160) at the inside of the housing (110) of the lock unit (100), the holding lug on the rotatable retainer sleeve having a stop end surface being located longitudinally at the front end of the rotatable retainer sleeve.

As illustrated in FIG. 14*a*-14*c*, the fixed front end sleeve portion (241) as well as the rotatable retainer sleeve portion (250) are provided with recesses (242, 252, 243, 243") at their inside cylindrical surfaces for accommodating radially projecting parts (351*a*, 351*b*, 351*c*, 880') of the at least one side locking mechanism.

As illustrated in FIGS. 7*a*, 7*c*, 7*d*, 8*a*, 8*c*, 8*d*, 13*a*, 13*d*, 14*a*-14*c*) the at least one side locking mechanism (451*a*, 451*b*, 461*a*, 461*b*; 851*a*, 851*b*, 880; 851*a*'-851*d*', 880') is provided on each side of the keyway (420; 820) wherein at least one of the locking tumblers (351*c*, 851*b*) is located in front of the first cavity (331*g*) of the key plug (400; 800).

As illustrated in FIGS. 4*m*, 4*p* and 9*c*, each of the coded side locking tumblers (351*b*, 551*b*) in the front region of the key plug (300, 500) is provided with a transverse finger (354*b*, 554) being held in direct contact with a side code pattern (41) on the associated key (40).

At least two each of the coded side locking tumblers (351*b*, 351*c*) are movable between a coded releasing position where they are totally confined within the key plug (300), and at least one locking position where they project radially outside the key plug and engage with the inside of the fixed front end sleeve portion (241), whereby it will prevent rotation of the key plug (300).

As illustrated in FIGS. 9*d*, 9*e*, 9*h*, 12*d* and 13*d*, the coded side locking tumblers (551*a*, 551*b*; 851*a*, 851*b*; 951*a*, 951*b*, 951*c*) in each side locking mechanism cooperate with an associated side bar (580; 880; 880'; 980) located at the cylindrical outer circumference of the key plug (500; 800; 900) and are adapted to engage with an associated groove (243) at the inside of the fixed front end sleeve portion (241), so as to prevent rotation of the key plug unless a correctly cut key is inserted into the keyway. The side bar is then seated inside the circumferential contour of the key plug.

As illustrated in FIGS. 9*c*, 10 and 11, each of the coded side locking tumblers (551*b*; 651*b*; 751*b*) is provided with a transverse finger (554; 654; 754) cooperating with a side code pattern on an associated key, and with at least one recess (555, 657, 755) in an outside portion thereof at a distance from the transverse finger, adapted to cooperate with the side bar (580; 680;780), so as to enable the latter to disengage from the groove (243) at the inside of the front end sleeve portion (241). As illustrated in FIG. 11, the transverse finger (754) is longitudinally displaced, along the keyway, to form a coded location, in relation to a central axis of the associated coded side locking tumbler (751*b*), with each locking tumbler being coded both in respect of the longitudinal displacement of the transverse finger with the location of the at least one recess (755) cooperating with the side bar (780).

As illustrated in FIG. 10, each of the coded side locking tumblers (651*b*) is movable up and down or elevationally as well as rotationally in an associated cavity, the rotational position also forming a code.

As illustrated in FIGS. 13*d* and 14*a*-14*c*, the key plug is provided with two side locking mechanisms each having a side bar (880; 880'), one on each side of the keyway.

As illustrated in FIG. 4*a*, the at least one side locking mechanism may extend backwards from the area adjacent to the first cavity (331*g*).

As illustrated in FIG. 14*b*, the at least one side locking mechanism interacts also with the rotatable retainer sleeve (250") which is provided with a longitudinally extending recess (261") for accommodating a radially projecting part (880') of the at least one side locking mechanism.

As illustrated in FIGS. 1, 2*b*, 4*a*, 4*c* and 4*d*, the row of locking pins (231*a*-231*g*) in the upper part (220) of the shell comprises six or seven locking pins adapted to cooperate with bittings on an edge portion (42) of the associated key (40) being inserted into the keyway (320). The rotatable retainer sleeve (250; 250'; 250") has a holding lug (260) adapted to engage, upon insertion of the interchangeable cylinder lock core into the lock unit (100), with a recess having a shoulder (160) at the inside of the housing (110) of the lock unit (100). The holding lug (260) on the rotatable retainer sleeve includes a stop end surface (260*a*) being located longitudinally at the front end of the rotatable retainer sleeve.

As illustrated in FIGS. 9*a*-9*h*, 12*a*-12*d*, 13*a*-13*d* and 14*a*-14*c*, an interchangeable cylinder lock core with a rotatable cylindrical key plug (500; 800; 800'; 900) is provided for use together with a lock unit having a housing dimensioned to receive the interchangeable cylinder lock core, and includes a torque transferring mechanism in the housing adapted to transfer a torque to the lock unit when the key plug is rotated.

As illustrated in FIGS. 9*a* and 9*b*, the interchangeable cylinder lock core includes a shell (210) having an outer contour dimensioned to fit into the housing. As illustrated in FIGS. 4*f*-4*i*, the shell includes an upper part (220; 220"; 220'") is provided with a central row of locking pins in associated cavities and a lower part with a cylindrical bore accommodating the rotatable key plug. At least a part of the cylindrical bore extends through a rotatable retainer sleeve (250, 250"). The rotatable key plug is also provided with a central row of associated cavities cooperating with the locking pins.

The rotatable retainer sleeve is provided with holes corresponding to the cavities for the locking pins and is also provided with an engaging member, adapted to releasably retain the interchangeable cylinder lock core in the housing, and to enable removal and replacement of the interchangeable cylinder lock core in relation to the housing of the lock unit. The key plug (500; . . . ; 900) is rotatable in the cylindrical bore and having a back region (L2; L3) extending from a back end, and a front region (FR2, FR3), which adjoins the back region and extends up to a front end of the key plug. A keyway (520) extends from the front end axially along the key plug and is configured to accommodate an associated key (40).

The central row of locking pins is arranged to engage with and lock the key plug against rotation in the lower part of the shell unless the associated key (40) is inserted into the keyway. The adjoining front region (FR2, FR3) of the key plug accommodates, in addition to the central row of locking pins, at least one side locking mechanism (551*a*, 551*b*; 580; 851*a*'-851*d*'; 880'; 951*a*, 951*b*, 951*c*; 980) on at least one lateral side thereof so as to engage with an inner circumferential surface of a fixed front end sleeve portion (241), which forms a portion of the lower part of the shell. The at least one side locking mechanism is operative independently of the central row of locking pins.

As illustrated in FIGS. 9*d*, 9*e* and 9*h*, the at least one side locking mechanism includes a longitudinal row of at least two coded side locking tumblers (551*a*, 551*b*) which are each movable independently of each other, there being at least three different code positions for each coded side locking tumbler and a plurality of different code combinations for the at least two side locking tumblers in the longitudinal row.

The longitudinal row of at least two coded side locking tumblers cooperate with an associated side bar (580, 880, 880', 980), forming a part of the side locking mechanism and are adapted to engage with an associated groove (243; 243") at the inside of the fixed front end sleeve portion (241). As illustrated in FIG. 9*d*, a spring (581) is disposed between the at least one pair of the locking tumblers cooperating with the side bar. At least a pair of side locking tumblers is located adjacent to the front end of the key plug.

The rotatable retainer sleeve (250) is arranged between the fixed front end sleeve portion (241) and a rear end sleeve portion (240), the sleeve portions defining the cylindrical bore together with the rotatable retainer sleeve. The rotatable retainer sleeve (250") extends from the back end of the key plug (800') up to the fixed front end sleeve portion.

As illustrated in FIGS. 4*d*, 14*b* and 14*c*, the rotatable retainer sleeve (250") has a thinner cylindrical wall than the fixed front end sleeve portion and the fixed front end sleeve portion is integrated with a rear end sleeve portion (240") having a thinner cylindrical wall than the front end sleeve portion, the rear end sleeve portion (240") being located radially outside the rotatable retainer sleeve (250") such that the retainer sleeve (250") and the front end sleeve portion define the cylindrical bore. The fixed front end sleeve portion as well as the rotatable retainer sleeve portion (250") are provided with recesses (243"; 261") at the inside cylindrical surfaces for accommodating the side bar (880') of the at least one side locking mechanism.

As illustrated in FIGS. 4*k* and 9*c*, each of the coded side locking tumblers (351*b*, 551*b*) in the front region of the key plug (300, 500) is provided with a transverse finger (354, 554) that is held in direct contact with a side code pattern (41) on the associated key (40).

Each of the coded side locking tumblers (551*b*; 651*b*; 751*b*) is provided with a transverse finger (554; 654; 754) cooperating with a side code pattern on an associated key, and with at least one recess (555, 657, 755) in an outside portion thereof at a distance from the transverse finger that is adapted to cooperate with the side bar (580; 680;780), so as to enable the latter to disengage from the groove (243; 243") at the inside of the front end sleeve portion (241; 240").

As illustrated in FIG. 11, the transverse finger (754) is longitudinally displaced, along the keyway, to form a coded location, in relation to a central axis of the associated coded side locking tumbler (751*b*), each locking tumbler being coded both in respect of the longitudinal displacement of the transverse finger, and the location of the at least one recess (755) cooperating with the side bar (780).

As illustrated in FIG. 10, each of the coded side locking tumblers (651*b*) is movable up and down or elevationally as well as rotationally in an associated cavity, the rotational position also forming a code.

As illustrated in FIGS. 13*d* and 14*a*-14*c*, the key plug may be provided with two side locking mechanisms each having a side bar (880; 880'), one on each side of the keyway.

In addition, the at least one side locking mechanism may extend backwards from the area adjacent to the first cavity (331*g*).

As illustrated in FIG. 14*b*, the at least one side locking mechanism may interact also with the rotatable retainer sleeve (250") which is provided with a longitudinally extending recess (261") for accommodating the side bar (880') of the at least one side locking mechanism.

As illustrated in FIG. 4*a*, the row of locking pins (231*a*-231*g*) in the upper part (220) of the shell comprises six or seven locking pins adapted to cooperate with bittings on an edge portion (42) of the associated key (40) being inserted into the keyway (320).

Those skilled in the art can modify, within the scope of the appended claims, the disclosed embodiments in many ways, for example by modifying the detailed structure of the key and the cylinder lock core with its retainer sleeve mechanism, the central locking pins (with associated top pins and springs), the coded side locking tumblers, the optional side bar and the overall configuration of the upper and lower parts of the shell.

In certain cases, e.g. to allow for manufacturing tolerances or where it is desirable to have a row of more than four coded side locking tumblers in a seven pin cylinder or to have a row of more than three coded side locking tumblers in a six pin cylinder, the minimum length L1 of the prong holes may be just half of the length (L1+FR1) of the key plug.

As illustrated in FIGS. 15, 16*a*, 16*b*, 16*c* and 16*d*, relating to a cylinder lock unit and a key according to a further, second aspect of the invention, a cylinder lock unit 1100 includes a housing in the form of a shell 1200 with an upper part 1220 and a lower part 1240. Here, the shell 1200 is integrated or permanently retained in the housing to form the cylinder lock unit 1100, and not divided into an external housing and an internal, exchangeable core as in the first aspect of the invention described above. Such a lock unit, with a housing and a rotatable key plug in a lower part thereof is disclosed e.g. in the U.S. Pat. No. 8,720,241 B1 (Widen).

Figure 16C:
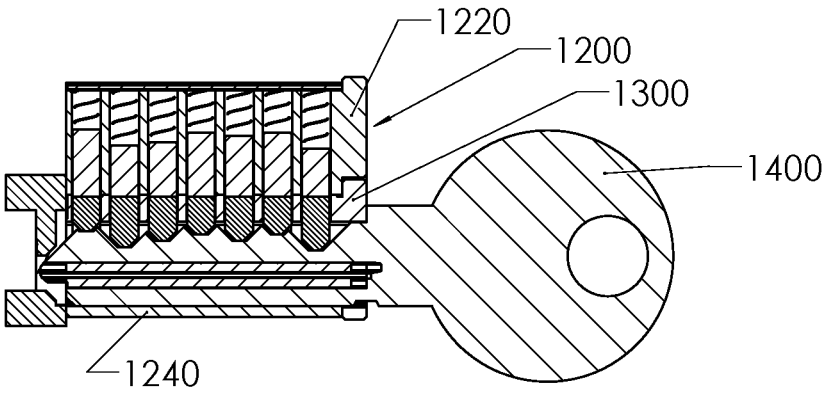
FIG. 16*c* shows longitudinal a section through the lock unit of FIG. 16*a;*
Figure 16D:
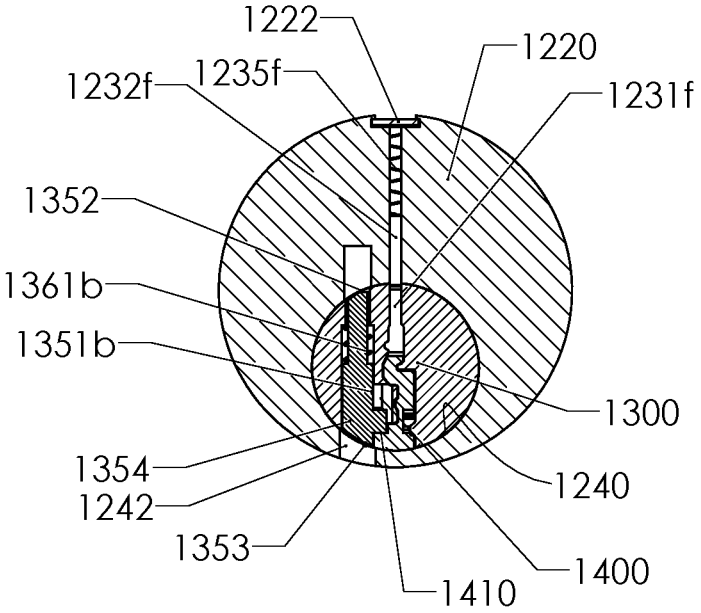
FIG. 16*d* shows a cross-section through the lock unit of FIG. 16*a*, at the location of a coded side locking tumbler.

In the description below of the second aspect of the invention, all references to "vertical", "upper," and "lower," etc. are related to the orientation of the lock unit as shown in FIGS. 15 and 16*d*. It is understood, however, that this orientation may be different in a particular embodiment of a lock unit and key combination according to the present invention.

Also, it should be clarified that the housing may have a different geometrical shape. The upper part may thus be an upright part extending upwardly from a lower part and accommodating upper locking pins interacting with a rotatable key plug in a lower part of the housing.

It has turned out that the basic inventive concept disclosed above, relating to a compact front region of the key plug which accommodates a front part of a central row of locking pins as well as at least one side locking mechanism in its entirety, is applicable also to a cylinder lock unit where the housing and shell are integrated with or permanently connected to each other.

Accordingly, in the second aspect of the invention, the lower part 1240 of the housing or shell 1200 has a cylindrical bore accommodating a rotatable key plug 1300. The rotatable key plug 1300 is formed in one piece and is adapted, via a torque transferring connection, e.g. including a cam member 1151 and fastening screws 1152*a*, 1152*b*, to transfer a torque to a locking mechanism when the key plug 1300 is rotated. The upper part 1220 of the housing or shell 1200 is provided with a central row of upper and lower locking pins 1232*a*-1232*g*, 1231*a*-1231*g* in associated cavities 1221*a*-1221*g*. Springs 1235*a*-1235*g* are provided, respectively, in association with the upper locking pins 1232*a*-1232*g*. A cover 1222 retains the springs 1235*a*-1235*g* and the upper and lower locking pins 1232*a*-1232*g*, 1231*a*-1231*g* within the housing or shell 1200.

The key plug 1300 includes a central row of corresponding cavities 1331*a*-1331*g* for accommodating the lower locking pins 1231*a*-1231*g* in the central row. In addition, the key plug 1300 has at least one side locking mechanism including side locking tumblers 1351*a*-1351*c* operatively positioned within associated cavities 1371*a*-1371*c* that are operative independently of the central row of upper and lower locking pins 1231*a*-1231*g*, 1232*a*-1232*g*. Springs 1361*a*-1361*c* are provided, respectively, in association with the at least one side locking mechanism 1351*a*-1351*c*. A keyway 1320 extends axially backwards from a front end flange 1310 of the key plug 1300 and is configured to accommodate an associated key 140.

As illustrated in FIG. 16*d*, showing a cross section of the key plug 1300, a central cavity 1331*f* (see also FIG. 16*a*) accommodates a lower locking pin 1231*f* in the central row. In addition, the key plug 1300 has at least one side locking mechanism with a side locking tumbler 1351*b* being positioned within an associated cavity 1371*b* (see FIG. 16*a*). The side locking mechanism is operative independently of the central row of upper and lower locking pins 1231*f*, 1232*f*. A spring 1361*b* is provided in association with the side locking tumbler 1351*b*. The side locking tumbler 1351*b* includes an upper portion 1352 and a lower portion 1354 having a surface 1353 that conforms to the outer surface of the key plug 1300 when an associated key 1400 is inserted into the keyway 1320. An opening 1242 is provided in the housing or shell 1240. The keyway 1320 extends axially backwards from the front end flange 1310 of the key plug 1300 and is configured to accommodate the associated key 1400 (see FIG. 16*b*).

The central row of upper and lower locking pins and the side locking mechanism, including the three side locking tumblers 1351*a*, 1351*b*, 1351*c*, are arranged to engage with and lock the key plug 1200 against rotation in the lower part 1240 of the housing or shell unless the associated key 1400 is inserted into the keyway 1320.

Figure 17A:
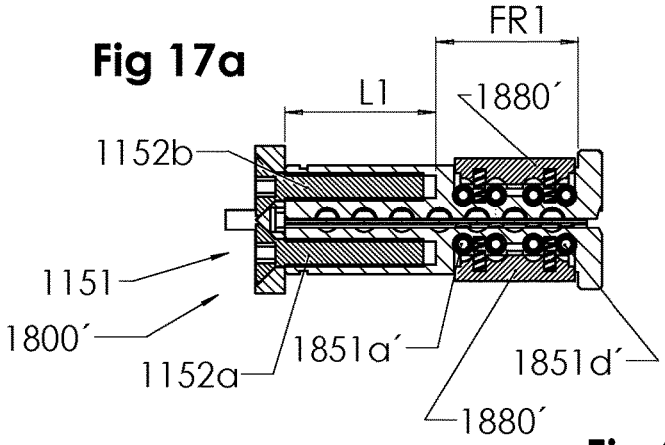
FIG. 17*a* shows a further embodiment of the rotatable plug of the lock unit according to the second aspect of the invention, with a longer side bar on each lateral side of the keyway, each cooperating with four coded side locking tumblers in a row.
Figure 17C:
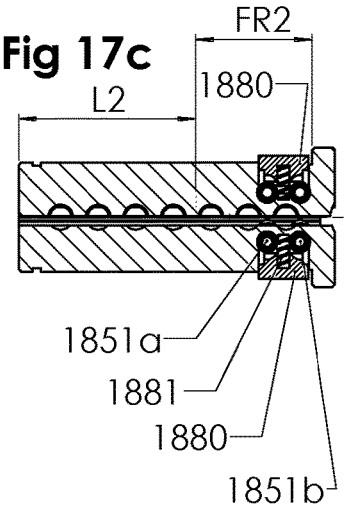
FIG. 17*c* shows another embodiment with a massive key plug having two shorter side bars, one on each lateral side of the keyway of the key plug.

As illustrated in FIGS. 17*a*, 17*a* and 17*c*, a back region L1 or L2 of the key plug 1300 has a minimum length of 50% of a total length of the key plug 1300. In addition, an adjoining front region FR1 of the key plug 1300 has a maximum length of 50% of the total length. The back region L1 of the key plug 1300 accommodates a rear part of the central row of corresponding cavities 1331*a*-1331*g*, which cooperate with the lower locking pins 1231*a*-1231*g* of the central row of locking pins, as well as two side portions, at each lateral side of the keyway 1320, being reserved for possibly accommodating at least one additional lock component. The front region FR1 of the key plug 1300 accommodates, on at least one lateral side of the keyway 1320, the at least one side locking mechanism.

The at least one side locking mechanism is confined entirely within the front region FR1 or FR2 of the key plug. The at least one side locking mechanism includes a longitudinal row of at least two coded side locking tumblers 1351*a*-1351*c*, each interacting with the lower part of the housing or shell 1200, either directly or indirectly via a side bar. The at least two coded side locking tumblers 1351*a*-1351*c* in each side locking mechanism are movable independently of each other, there being at least three different code positions for each coded side locking tumbler and a plurality of different code combinations for the at least two coded side locking tumblers in each longitudinal row in the front region of the key plug.

As illustrated in FIG. 16*a*, the longitudinal row of coded side locking tumblers in the side locking mechanism may include at least three coded side locking tumblers 1351*a*, 1351*b*, 1351*c*. In addition, the at least one additional lock component may include a part of the torque transferring connection 1152*a*, 1152*b* wherein the part of the torque transferring connection may include at least one fastening screw 1152*a*, 1152*b*.

Figure 17B:
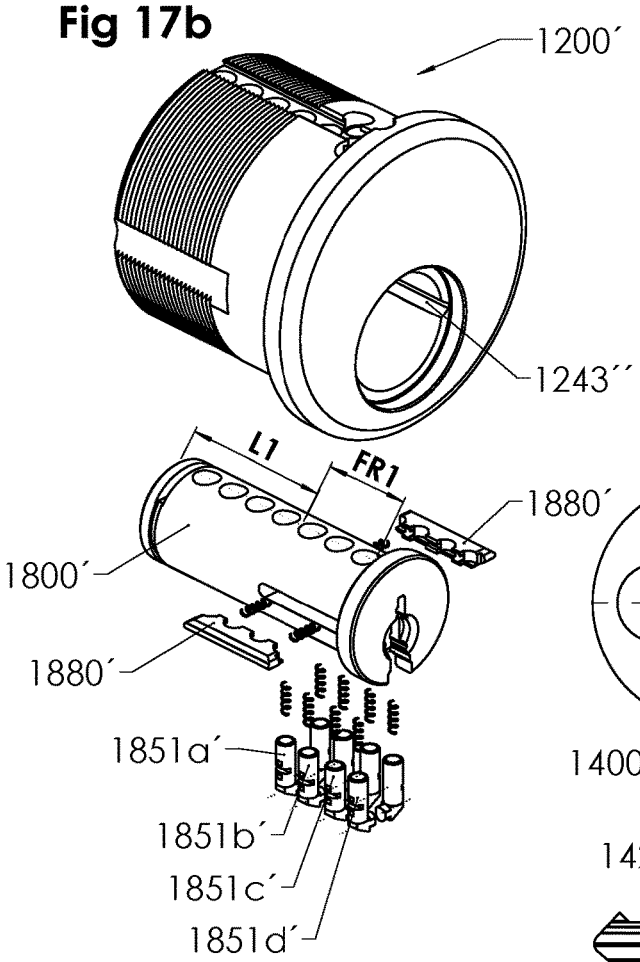
FIG. 17*b* shows an exploded view of the various parts of a lock and key system according to the second embodiment of the present invention, including a housing or shell, and a rotatable key plug according to FIG. 17*a;*

As illustrated in FIGS. 17*a* and 17*b*, the key plug 1800' may be provided with two side locking mechanisms, e.g. each including a side bar 1880', one on each side of the keyway. The coded side locking tumblers 1851*a*', 1851*b*', 1851*c*' and 1851*d*' cooperate with an associated side bar 1880'. Here, since the side locking mechanisms are arranged on both lateral sides of the keyway, each with four coded side locking tumblers in a row, the result will be a very large number of code combinations.

Each of the coded side locking tumblers in the front region FR1 of the key plug may be provided with a transverse finger (similar to the transverse finger 554 as illustrated in FIG. 9*c*) being held in direct contact with a side code pattern 1410 on the associated key 1400, as illustrated in FIGS. 16*a* and 16*d*, when the key 1400 is being inserted into the keyway 1320, provided that a side code pattern 1410 of the key is configured to interact with such transverse fingers on the coded side locking tumblers.

As illustrated in FIG. 16*a*, at least two of the coded side locking tumblers 1351*a*-1351*c* are movable between a coded releasing position where they are totally confined within the key plug 1300, and at least one locking position where they project radially outside the key plug 1300 and engages with at least one recess 1242 in the housing or shell 1200, whereby the at least two coded side locking tumblers 1351*a*-1351*c* will prevent rotation of the key plug 1300.

As mentioned above and as illustrated in FIG. 17*b*, the longitudinal row of coded side locking tumblers 1851*a*-1851*c* in each side locking mechanism may cooperate with an associated side bar 1880', forming a part of the side locking mechanism and being located at the cylindrical outer circumference of the key plug and being adapted to engage with an associated groove 1243" at the inside of the housing or shell 1200', so as to prevent rotation of the key plug unless a correctly cut key is inserted into the keyway, the side bar 1880' being then seated inside the circumferential contour of the key plug. The coded side locking tumblers 1851*a*'-1851*d*' cooperate with the associated side bar 1880'. Again, since the side locking mechanisms are arranged on both lateral sides of the keyway, each with four coded side locking tumblers in a row, the result will be a very large number of code combinations.

Each of the coded side locking tumblers 1351*a*-1351*c* and 1851*a*-1851*c* may be provided with a transverse finger cooperating with a side code pattern on an associated key, and with at least one coded recess in an outside portion thereof at a vertical distance from the transverse finger, adapted to cooperate with the side bar, so as to enable the latter to disengage from the groove at the inside of the housing. The transverse finger may be longitudinally displaced, along the keyway, to form a coded location, in relation to a central axis of the associated coded side locking tumbler, each locking tumbler being coded both in respect of the longitudinal displacement of the transverse finger, and the location of the at least one coded recess cooperating with the side bar. Each of the coded side locking tumblers 1351*a*-1351*c* and 1851*a*-1851*c* may be movable up and down as well as rotationally in an associated cavity, the rotational position also forming a code.

In addition, at least one of the side tumblers is positioned in front of the first cavity. Preferably, the at least one side locking mechanism extends backwards from an area adjacent to the first cavity.

As illustrated in FIG. 17*c*, at least one spring is disposed between two coded side locking tumblers cooperating with the side bar 1880, there being no spring located between a coded side locking tumbler 1851*b* and an end of the side bar 1880. A single spring 1881 may be disposed between two neighboring coded side locking tumblers 1851*a*, 1851*b* being located closest to the front end of the key plug 1300 and cooperating with the side bar 1880.

As illustrated in FIG. 17*c*, the back region L2 of the key plug 1300 may be massive except for the rear part of the central row of corresponding cavities (the connection to the cam member is not illustrated in this figure).

The coded side locking tumblers 351*a*, 351*c* (see FIG. 4*a*) may be movable in a plane which is displaced laterally in relation to the keyway 320.

As illustrated in FIGS. 16*a* and 17*a*-17*c*, the row of locking pins in the upper part of the housing comprises six or seven locking pins adapted to cooperate with bittings on an edge portion of the associated key being inserted into the keyway.

As illustrated in FIGS. 16*b* and 16*c*, a key 140 is provided for unlocking a cylinder lock unit 1100 that includes a rotatable cylindrical key plug with a side locking mechanism confined to a front region thereof as well as a central row of locking pins interacting with a corresponding row of cavities in the key plug, the key plug comprising a grip portion and a key blade. The key blade has a wave-like side code pattern consisting of a row of at least two side code portions being substantially confined to the longitudinal half of the key blade located closest to the grip portion, the wave-like side code pattern adjoining to a straight profile groove extending towards the free end of the key blade. In addition, the key blade also has an edge code pattern 1420 comprising a longitudinal continuous row of code portions defined by V-shaped bittings. In one embodiment, at least one of the code portions 1410 of the wave-like side code pattern is located closer to the grip portion of the key than all the code portions of the edge code pattern. In addition, in an embodiment, the side code portions of the wave-like side code pattern may be arranged in a continuous row in the longitudinal half of the key blade.

If desired, the central row of lower locking pins may have chisel end portions, interacting with the V-cuts on the associated key and also cooperating with a side bar (also cooperating with the side locking tumblers), as disclosed e.g. in the U.S. Pat. No. 8,720,241 B1 (Widen), resulting in an even higher degree of security because of the additional increase in possible code combinations. The V-shaped bittings of such an edge code pattern may then be screw cut at different angles.

Figure 18A:
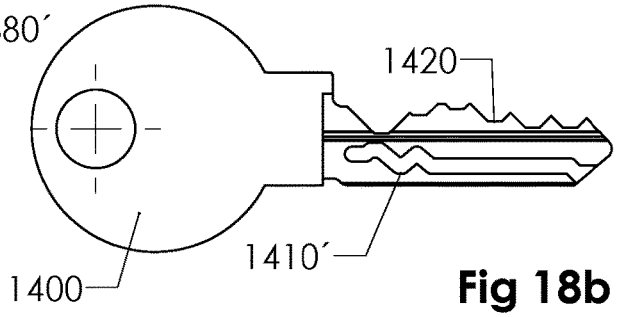
FIG. 18*a* shows a side view of a first side of a key according to the invention.
Figure 18B:
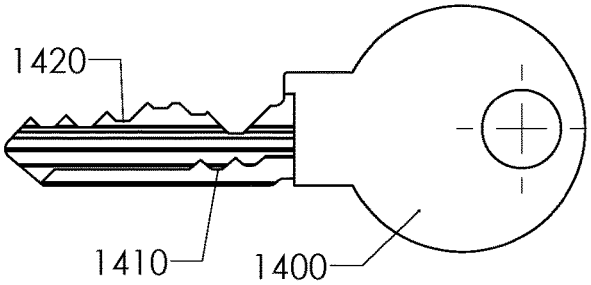
FIG. 18*b* shows an opposite, second side of the key of FIG. 18*a*, the first and second sides of the key having different kinds of profile grooves each having a side code pattern.

As shown in FIGS. 18*a* and 18*b*, the key blade may have a wave-like side code pattern on both sides thereof. The two sides may be of the same kind, or they may be different from each other. As an example, in FIG. 18*a*, the side code pattern is formed at the lower wall surface of a wave-like profile groove 1410', where the upper wall surface of the groove follows the same wave-like pattern and will form a guiding groove in which a finger of a side locking tumbler will be positively guided up and down when the key 1400 is being inserted into the keyway of the lock. At the other side of the key blade, on the other hand, the lower wall surface 1410 is a one-sided guiding surface, and the associated finger of the side locking tumbler will be held in contact with this wave-like wall surface 1410 by means of spring (not shown). The opposite upper wall of the profile groove is rectilinear in this case. The key 1400 also has an upper edge code 1420 as shown in FIGS. 18*a* and 18*b*.

As is well-known in this kind of technology, the side code portions of the wave-like code pattern may be formed by concavities.

Also, the profile groove 1410 may be undercut and have a ridge portion, in which each side code portion is formed as a concavity so as to form the wave-like side code pattern.

As also known per se, see e.g. the U.S. Pat. Nos. 4,756,177, 5,715,717 and 7,810,364 (all in the name of Widen), each side code portion may be selected from a group of possible code positions, including, at different vertical levels:

a central position, corresponding to the position of an axis of a side locking tumbler when the key is fully inserted into a keyway in said associated lock unit, a forwardly displaced position being displaced longitudinally at an incremental distance from said central position towards the free end of the key blade, and a rearwardly displaced position being displaced longitudinally at an incremental distance from said central position towards the grip portion of the key, said central position, said forwardly displaced position and said rearwardly displaced positions each corresponding to a particular position of a transverse finger on the side locking tumbler when the key is fully inserted into the keyway of the associated lock unit.

Finally, the present invention also provides for a key blank for producing a key as described above. Such a key blank may comprise a grip portion and a key blade, wherein the key blade, on at least one side thereof, has a wave-like side code pattern consisting of a row of at least two side code portions being substantially confined to the longitudinal half of the key blade located closest to the grip portion, and the key blade also has an edge portion configured to permit the cutting of a longitudinal row of V-shaped bittings so as to form an edge code pattern on a finished key.

Such a key blank may have a wave-like side code pattern on both sides of the key blade.

It is also possible to make a key from such a key blank, without any edge code pattern, and only one or two side code patterns, for use in a lock unit having one or two side bars in the key plug, and no central row of locking pins.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder lock unit, comprising a housing having an upper part and a lower part, said lower part of the housing having a cylindrical bore accommodating a rotatable key plug, said rotatable key plug being formed in one piece and being adapted, via a torque transferring connection, to transfer a torque to a locking mechanism when the key plug is rotated, said upper part being provided with a central row of upper and lower locking pins in associated cavities, said key plug having a central row of corresponding cavities for accommodating said lower locking pins in said central row, said key plug having at least one side locking mechanism being operative independently of said central row of upper and lower locking pins, a keyway extending axially backwards from a front end of said key plug and being configured to accommodate an associated key, said central row of upper and lower locking pins and said side locking mechanism being arranged to engage with and lock the key plug against rotation in said lower part of said housing unless said associated key is inserted into said keyway, wherein:

a back region of the key plug has a minimum length of 50% of a total length of the key plug, whereas an adjoining front region of the key plug has a maximum length of 50% of said total length, said back region of the key plug accommodates a rear part of said central row of corresponding cavities, which cooperate with said lower locking pins of said central row of locking pins, as well as two side portions, at each lateral side of said keyway, being reserved for possibly accommodating at least one additional lock component, said front region of the key plug accommodates, on at least one lateral side of said keyway, said at least one side locking mechanism, said at least one side locking mechanism is confined entirely within said front region of the key plug, thus forming a front end side locking mechanism, said at least one front end side locking mechanism comprises a longitudinal row of at least two coded side locking tumblers, each interacting with the lower part of the housing, either directly or indirectly via a side bar, and said at least two coded side locking tumblers in each front end side locking mechanism are movable independently of each other, there being at least three different code positions for each coded side locking tumbler and a plurality of different code combinations for the at least two side locking tumblers in each said longitudinal row in said front region of the key plug.

2. The cylinder lock unit as defined in claim 1, wherein said longitudinal row of coded side locking tumblers in said front end side locking mechanism comprises at least three coded side locking tumblers.

3. The cylinder lock unit as defined in claim 1, wherein said at least one additional lock component comprises a part of said torque transferring connection.

4. The cylinder lock unit as defined in claim 3, wherein said part of said torque transferring connection comprises at least one fastening screw.

5. The cylinder lock unit as defined in claim 1, wherein said key plug is provided with two front end side locking mechanisms, one on each side of said keyway.

6. The cylinder lock unit as defined in claim 1, wherein each of said coded side locking tumblers in said front end side locking mechanism of the key plug is provided with a transverse finger being held in direct contact with a side code pattern on said associated key when the key is being inserted into said keyway.

7. The cylinder lock unit as defined in claim 1, wherein at least two of said coded side locking tumblers are movable between a coded releasing position where they are totally confined within the key plug, and at least one locking position where they project radially outside the key plug and engage with at least one recess in said housing, whereby they will prevent rotation of the key plug.

8. The cylinder lock unit as defined in claim 1, wherein said longitudinal row of coded side locking tumblers in each front end side locking mechanism cooperate with an associated side bar, forming a part of said front end side locking mechanism and being located at the cylindrical outer circumference of the key plug and being adapted to engage with an associated groove at the inside of said housing, so as to prevent rotation of the key plug unless said associated key is inserted into said keyway, the side bar being then seated inside the circumferential contour of the key plug.

9. The cylinder lock unit as defined in claim 8, wherein each of said coded side locking tumblers is provided with a transverse finger cooperating with a side code pattern on said associated key, and with at least one coded recess in an outside portion thereof at a distance from said transverse finger, adapted to cooperate with said side bar, so as to enable the latter to disengage from said groove at the inside of said housing.

10. The cylinder lock unit as defined in claim 9, wherein said transverse finger is longitudinally displaced, along said keyway, to form a coded location, in relation to a central axis of the associated coded side locking tumbler, each locking tumbler being coded both in respect of the longitudinal displacement of the transverse finger, and the location of said at least one coded recess cooperating with said side bar.

11. The cylinder lock unit as defined in claim 9, wherein each of said coded side locking tumblers is movable up and down as well as rotationally in an associated cavity, the rotational position also forming a code.

12. The cylinder lock unit as defined in claim 8, wherein at least one of said side locking tumblers is positioned in front of a first one of said corresponding cavities in said central row.

13. The cylinder lock unit as defined in claim 12, wherein said at least one front end side locking mechanism extends backwards from an area adjacent to said first one of said corresponding cavities in said central row.

14. The cylinder lock unit as defined in claim 8, wherein at least one spring is disposed between two coded side locking tumblers cooperating with said side bar, there being no spring located between a coded side locking tumbler and an end of the side bar.

15. The cylinder lock unit as defined in claim 14, wherein a single spring is disposed between the two neighboring coded side locking tumblers being located closest to said front end of the key plug and cooperating with said side bar.

16. The cylinder lock unit as defined in claim 1, wherein said back region of the key plug is massive except for said rear part of said central row of corresponding cavities.

17. The cylinder lock unit as defined in claim 1, wherein the coded side locking tumblers are movable in a plane which is displaced laterally in relation to the keyway.

18. The cylinder lock unit as defined in claim 1, wherein said row of locking pins in said upper part of said housing comprises six or seven locking pins adapted to cooperate with bittings on an edge portion of said associated key being inserted into said keyway.

19. A key for unlocking an associated cylinder lock unit having a rotatable cylindrical key plug having a front end side locking mechanism confined to a front region thereof as well as a central row of locking pins in a corresponding row of cavities in the key plug, the key comprising a grip portion and a key blade, wherein said key blade, on at least one side thereof, has a wave-like side code pattern consisting of a row of at least two side code portions being substantially confined to the longitudinal half of the key blade located closest to said grip portion, said wave-like side code pattern adjoining to a straight profile groove extending towards a free end of the key blade, and said key blade also has an edge code pattern comprising a longitudinal row of code portions defined by V-shaped bittings.

20. The key as defined in claim 19, wherein at least one of said code portions of the wave-like side code pattern is located closer to the grip portion of the key than all the code portions of said edge code pattern.

21. The key as defined in claim 19, wherein the side code portions of said wave-like side code pattern are arranged in a continuous row in said longitudinal half of the key blade.

22. The key as defined in claim 19, wherein said key blade has a wave-like side code pattern on both sides thereof.

23. The key as defined in claim 19, wherein said wave-like side code pattern is located at a wall surface of a profile groove in at least one side surface of the key blade, each of said code portions being formed by a concavity in said wave-like side code pattern.

24. The key as defined in claim 23, wherein said profile groove is undercut and comprises a ridge portion, where said side code portions are located.

25. The key as defined in claim 19, wherein each of said at least two side code portions is selected from a group of possible code positions, said possible code positions including, at different vertical levels:

a central position, corresponding to the position of an axis of a side locking tumbler when the key is fully inserted into a keyway in said associated lock unit, a forwardly displaced position being displaced longitudinally at an incremental distance from said central position towards said free end of the key blade, and a rearwardly displaced position being displaced longitudinally at an incremental distance from said central position towards said grip portion of the key, said central position, said forwardly displaced position and said rearwardly displaced positions each corresponding to a particular position of a transverse finger on said side locking tumbler when the key is fully inserted into said keyway of the associated lock unit.

26. The key as defined in claim 19, wherein said V-shaped bittings of said edge code pattern are skew cut at different angles.

27. The key blank for producing a key as defined in claim 19, said key blank comprising a grip portion and a key blade, wherein said key blade, on at least one side thereof, has a wave-like side code pattern consisting of a row of at least two side code portions being substantially confined to said longitudinal half of the key blade located closest to said grip portion, and said key blade also has an edge portion configured to permit the cutting of a longitudinal row of V-shaped bittings so as to form said edge code pattern on a finished key.

28. The key blank as defined in claim 27, wherein said key blade has a wave-like side code pattern on both sides of the key blade.

29. The key made from a key blank as defined in claim 27, wherein the key blade has at least one wave-like side code pattern, and no edge code pattern.

30. The key as defined in claim 29, wherein the key blade has two wave-like side code patterns, one on each side thereof, and no edge code pattern.

31. A key for unlocking an associated cylinder lock unit having a rotatable cylindrical key plug having a front end side locking mechanism, including at least two side locking tumblers, being confined to a front region thereof, the key comprising a grip portion and a substantially flat key blade with two sides, wherein said key blade has, on at least one of said two sides, a wave-like side code wave pattern consisting of a row of at least two side code wave portions being confined to a first portion of the key blade, said first portion adjoining directly to said grip portion and having a first longitudinal length constituting no more than 50% of the total length of the key blade, said at least two side code wave portions defining a wave-like curve with code portions and wave flanks rising and falling in a plane being parallel to a respective side of said key blade, said wave-like side code wave pattern in said first portion adjoins to a straight second portion of the key blade, and said second portion extends to a free end of the key blade and has a longitudinal length constituting at least 50% of said total length of the key blade.

32. The key as defined in claim 31, wherein said substantially flat key blade also has an edge code pattern comprising a longitudinal row of code portions defined by V-shaped bittings.

33. The key as defined in claim 32, wherein at least one of said side code portions of said side code wave pattern is located closer to the grip portion than all the code portions of said edge code pattern.

34. The key as defined in claim 31, wherein said wave-like side code wave pattern in said first portion and said straight second portion are formed in a longitudinal profile groove.

35. The key as defined in claim 34, wherein said profile groove has two opposite surfaces, at least one which serves to guide said at least two side locking tumblers when the key is inserted in said associated lock unit.

36. The key as defined in claim 31, wherein said substantially flat key blade has a wave-like side code wave pattern on both sides thereof.

37. The key as defined in claim 31, wherein the two sides of the substantially flat key blade have two different kinds of side code patterns.

38. The key as defined in claim 31, wherein said side code wave portions include concavities which form said side code portions of said side code wave pattern.

39. The key as defined in claim 31, wherein a free end portion of said key blade, at said at least one of said two sides, includes an inclined ramp surface extending from a lower edge of the key blade so to adjoin to said straight portion at said second portion of said key blade.

* * * * *